US010289055B2

(12) United States Patent
Koyama et al.

(10) Patent No.: US 10,289,055 B2
(45) Date of Patent: May 14, 2019

(54) DRIVE TRANSMITTING APPARATUS AND IMAGE FORMING APPARATUS

(71) Applicant: CANON KABUSHIKI KAISHA, Tokyo (JP)

(72) Inventors: Fuyuko Koyama, Yokohama (JP); Takeo Kawanami, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 15/783,075

(22) Filed: Oct. 13, 2017

(65) Prior Publication Data

US 2018/0113412 A1 Apr. 26, 2018

(30) Foreign Application Priority Data

Oct. 21, 2016 (JP) ..... 2016-206762

(51) Int. Cl.
*G03G 15/00* (2006.01)

(52) U.S. Cl.
CPC ..... *G03G 15/757* (2013.01)

(58) Field of Classification Search
CPC ..... G03G 15/757; G03G 15/1615
See application file for complete search history.

(56) References Cited

U.S. PATENT DOCUMENTS 7,610,938 B2 11/2009 Yanokura et al.
9,546,693 B2 1/2017 Matsumoto et al.
2015/0338817 A1* 11/2015 Huang ..... G03G 15/757 399/167
2016/0231688 A1* 8/2016 Huang ..... G03G 21/1857
2016/0282798 A1* 9/2016 Matsuoka ..... G03G 15/757
2017/0060039 A1* 3/2017 Morita ..... G03G 15/757
2017/0089400 A1* 3/2017 Matsumoto ..... F16D 1/0894
2017/0227918 A1* 8/2017 Huang ..... G03G 15/757
2017/0293255 A1* 10/2017 Uratani ..... G03G 21/1647

FOREIGN PATENT DOCUMENTS

JP 2006-289496 A 10/2006
JP 2013-103234 A 5/2013
JP 2013-164163 A 8/2013

* cited by examiner

*Primary Examiner* — Sevan A Aydin
(74) *Attorney, Agent, or Firm* — Venable LLP

(57) ABSTRACT

When viewed in an axial direction, a pair of circumferential ends and a notched portion of a cylindrical shaft are at different positions in a circumferential direction, and a first central angle of a first imaginary arc which connects the pair of circumferential ends and a first force receiving portion nearest to the pair of circumferential ends in an opposite direction to a direction, in which a force is received, from the pair of circumferential ends to the first force receiving portion in the opposite direction is smaller than a second central angle of a second imaginary arc, which connects the pair of circumferential ends and a second force receiving portion nearest to the pair of circumferential ends in the direction, in which the force is received, from the pair of circumferential ends to the second force receiving portion in the direction in which the force is received.

17 Claims, 20 Drawing Sheets

DRIVE TRANSMITTING APPARATUS AND IMAGE FORMING APPARATUS

BACKGROUND OF THE INVENTION

Field of the Invention

The present invention relates to a driving force transmitting mechanism in an image forming apparatus.

Description of the Related Art

Conventionally, a metallic solid shaft has been used for many shaft-like drive transmitting members such as various roller shafts used in image forming apparatuses such as copiers and printers. In contrast, the use of a hollow-structure cylindrical shaft (a metal plate cylindrical shaft) which is a metal plate formed in a cylindrical shape as a hollow shaft (a tubular shaft) in place of a solid shaft is being proposed for the purposes of reducing weight and lowering costs such as material cost and machining cost. However, compared to a metallic solid shaft, a metal plate cylindrical shaft having a seam at which end surfaces of a metal plate formed in a cylindrical shape come together tends to have lower torsional rigidity, and there is a concern that rotation with high accuracy cannot be performed. In addition, there is a concern that, when loads due to drive transmission and the like is applied to the metal plate cylindrical shaft, the respective end surfaces of the seam portion may deviate in a radial direction and an axial direction of the cylindrical shaft or the end surfaces may separate from each other to widen the seam, thereby causing a further decline in torsional strength.

In consideration thereof, in Japanese Patent Application Laid-open No. 2006-289496, by providing a protruded shape and a recessed shape to each end surface of a seam of metal plate end surfaces and having the protruded shape and the recessed shape fit each other, a deviation and a separation of the respective end surfaces of the seam in an axial direction are suppressed and torsional rigidity is improved.

SUMMARY OF THE INVENTION

Japanese Patent Application Laid-open No. 2006-289496 discloses a configuration in which a width of an end surface in a protruding direction of a protruded shape and a width of an end surface in a recessing direction of a recessed shape provided on each end surface of a seam are wider than a width of a base. Although this configuration is effective in suppressing a deviation and a separation of the respective end surfaces of the seam, an end of a protruded portion of the protruded shape cannot be inserted from a base side of the recessed shape. Therefore, when forming a cylindrical shape by a bending process of a metal plate cylindrical shaft, special consideration is required to ensure that the protruded shape and the recessed shape smoothly fit each other.

Meanwhile, Japanese Patent Application Laid-open No. 2013-164163 discloses a configuration in which an angle between an end surface and a side surface in a protruding direction of a protruded shape and an angle between an end surface and a side surface in a recessing direction of a recessed shape provided on each end surface of a seam are set at an approximately right angle. In addition, it is also described that the angles may be formed in obtuse angles in order to enable the protruded shape and the recessed shape to fit each other more readily during press working. However, in such cases, although a deviation in an axial direction of the respective end surfaces of the seam can be suppressed by a load applied to a metal plate cylindrical shaft due to drive transmission and the like, there is still a concern that the protruded shape and the recessed shape having been fitted to each other and the respective end surfaces may separate and the seam may open.

An object of the present invention is to provide a technique for suppressing, with a simple configuration, a decline in torsional strength of a cylindrical shaft which transmits a driving force by rotation.

In order to achieve the object described above, a drive transmitting apparatus according to the present invention includes:

a first member;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam and a notched portion that is recessed in the axial direction on an approximately annular end surface at an end in the axial direction, and the cylindrical shaft receiving a force in the circumferential direction at the notched portion, wherein when viewed in the axial direction, the pair of circumferential ends and the notched portion are at different positions in the circumferential direction.

In order to achieve the object described above, a drive transmitting apparatus according to the present invention includes:

a first member;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam, and a notched portion that is recessed in the axial direction on an approximately annular end surface at an end in the axial direction, and the cylindrical shaft engaging with the first member in the notched portion and receiving the driving force of the first member in the circumferential direction, wherein when viewed in the axial direction, the pair of circumferential ends and the notched portion are at different positions in the circumferential direction.

In order to achieve the object described above, a drive transmitting apparatus according to the present invention includes:

a first member that drives;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam, and a notched portion that is recessed in the axial direction on an approximately annular end surface at an end in the axial direction, and the cylindrical shaft engaging with the second member in the notched portion and causing the driving force to act on the second member in the circumferential direction, wherein when viewed in the axial direction, the pair of circumferential ends and the notched portion are at different positions in the circumferential direction, the notched portion includes, as force applying portions that cause the driving force to act on the second member, a first force applying portion that is nearest to the pair of circumferential ends in a rotation direction of the cylindrical shaft and a second force applying portion that is nearest to the pair of circumferential ends in an opposite direction to the rotation direction, and when a first central angle denotes a central angle of an imaginary arc, which connects the pair of circumferential ends and the first force applying portion in the rotation direction from the pair of circumferential ends to the first force applying portion, and which has as a center thereof the rotational center, and when a second central angle denotes a central angle of an imaginary arc, which connects the pair of circumferential ends and the second force applying portion in the opposite direction from the pair of circumferential ends to the second force applying portion, and which has as a center thereof the rotational center, the first central angle is smaller than the second central angle.

In order to achieve the object described above, an image forming apparatus according to the present invention includes:

the drive transmitting apparatus; and an image forming portion that forms an image on a recording material by using a driving force transmitted by the drive transmitting apparatus.

According to the present invention, a decline in torsional strength of a cylindrical shaft which transmits a driving force by rotation can be suppressed with a simple configuration.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

As an image forming apparatus according to a first embodiment of the present invention, a full-color electrophotographic image forming apparatus image forming apparatus with four process cartridges attachable thereto and detachable therefrom will now be exemplified. However, the number of process cartridges to be mounted to the electrophotographic image forming apparatus (hereinafter, referred to an image forming apparatus) is not limited thereto and is to be appropriately set as necessary. For example, in the case of an image forming apparatus that forms black and white images, the number of process cartridges mounted to the image forming apparatus is one. In addition, while a printer will be exemplified as a mode of the image forming apparatus in the embodiment described below, image forming apparatuses are not limited thereto. For example, the present invention can also be applied to other image forming apparatuses including as a copier and a facsimile apparatus as well as a multifunction machine that combines these functions.

Figure 1:
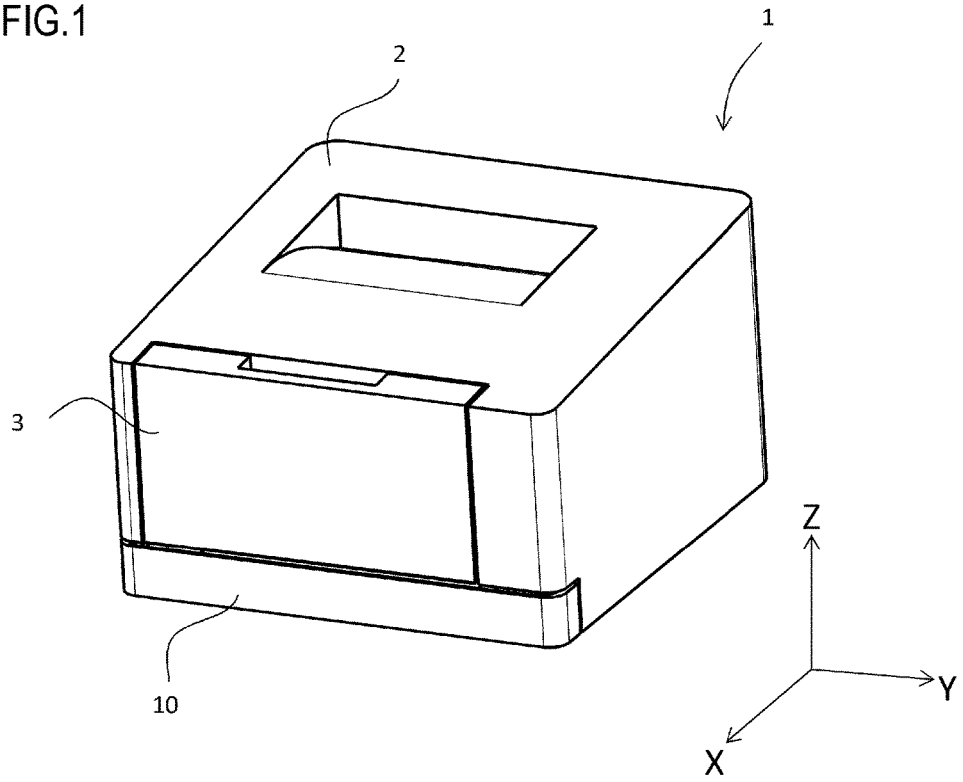
FIG. 1 is a perspective view of an example of an image forming apparatus according to an embodiment of the present invention.
Figure 2:
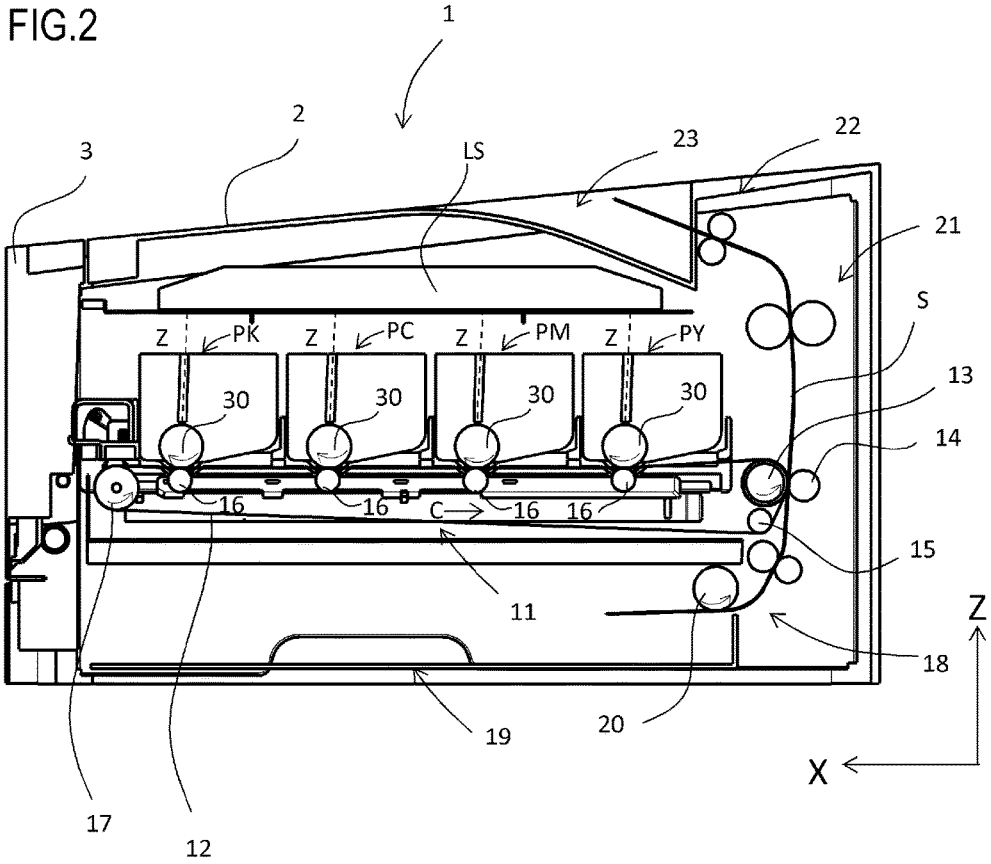
FIG. 2 is a sectional schematic view of an example of an image forming apparatus according to an embodiment of the present invention.

FIG. 1 is an external perspective view of an image forming apparatus according to an embodiment of the present invention, and FIG. 2 is a sectional schematic view of the image forming apparatus according to the embodiment of the present invention. This image forming apparatus 1 is a four-color full-color laser printer using an electrophotographic process which forms a color image on a sheet S. The image forming apparatus 1 adopts a process cartridge system in which a process cartridge P (hereinafter, referred to as a cartridge) is detachably mounted to an apparatus main body 2 and a color image is formed on a sheet S.

With respect to the image forming apparatus 1, it is assumed that a side on which an apparatus open/close door 3 and a cassette cover 10 (a cover of a paper feeding cassette that houses the sheet S as a recording material) is the front (a front surface) and a surface opposite to the front is the rear (a back surface). In addition, a right side of the image forming apparatus 1 as viewed from the front will be referred to as a driving side and a left side will be referred to as a non-driving side.

In the apparatus main body 2, four cartridges P (PY, PM, PC, and PK) including a first cartridge PY, a second cartridge PM, a third cartridge PC, and a fourth cartridge PK are arranged in a horizontal direction. Each of the first to fourth cartridges P (PY, PM, PC, and PK) has a similar electrophotographic process mechanism but has a developer (hereinafter, referred to as toner) of a different color. A rotational driving force is transmitted to the first to fourth cartridges P (PY, PM, PC, and PK) from a cartridge drive transmitting portion (not shown) of the apparatus main body 2.

In addition, bias voltage (a charging bias, a developing bias, and the like) is supplied (not shown) to each of the first to fourth cartridges P (PY, PM, PC, and PK) from the apparatus main body 2.

The first cartridge PY houses yellow (Y) toner and forms a yellow toner image on a surface of a photosensitive drum 30.

The second cartridge PM houses magenta (M) toner and forms a magenta toner image on the surface of the photosensitive drum 30.

The third cartridge PC houses cyan (C) toner and forms a cyan toner image on the surface of the photosensitive drum 30.

The fourth cartridge PK houses black (K) toner and forms a black toner image on the surface of the photosensitive drum 30.

A laser scanner unit LS as exposing means is provided above the first to fourth cartridges P (PY, PM, PC, and PK). The laser scanner unit LS outputs laser light Z in correspondence with image information. In addition, the laser light Z passes through an exposure window portion of the cartridge P and scans and exposes the surface of the photosensitive drum 30.

An intermediate transfer belt unit 11 as a transfer member is provided below the first to fourth cartridges P (PY, PM, PC, and PK). The intermediate transfer belt unit 11 includes a driver roller 13, a tension roller 17, and an assist roller 15, and a flexible transfer belt 12 is stretched over the intermediate transfer belt unit 11. The transfer belt 12 is rotationally driven in a direction of an arrow C by the driver roller 13. A rotational driving force is transmitted to the driver roller 13 from a belt drive transmitting portion 50 (to be described later) as a drive transmitting apparatus of the apparatus main body 2.

A lower surface of the photosensitive drum 30 of the first to fourth cartridges P (PY, PM, PC, and PK) is in contact with an upper surface of the transfer belt 12. The contact portion constitutes a first transfer portion. A primary transfer roller 16 is provided so as to oppose the photosensitive drum 30 on an inner side of the transfer belt 12. A secondary transfer roller 14 abuts with the driver roller 13 via the transfer belt 12. A contact portion between the transfer belt 12 and the secondary transfer roller 14 constitutes a second transfer portion. A paper feeding unit 18 is provided below the intermediate transfer belt unit 11. The paper feeding unit 18 includes a paper feeding cassette 19 in which the sheet S is stacked and housed and a sheet paper feeding roller 20.

A fixing unit 21 and a discharging unit 22 are provided in upper left in the apparatus main body 2 shown in FIG. 2. An upper surface of the apparatus main body 2 constitutes a discharge tray 23. A toner image is fixed to the sheet S by fixing means provided in the fixing unit 21, and the sheet S is discharged to the discharge tray 23. The configuration described above which is involved in the process of forming an image on the sheet S (a recording material) corresponds to the image forming portion according to the present invention.

Figure 3:
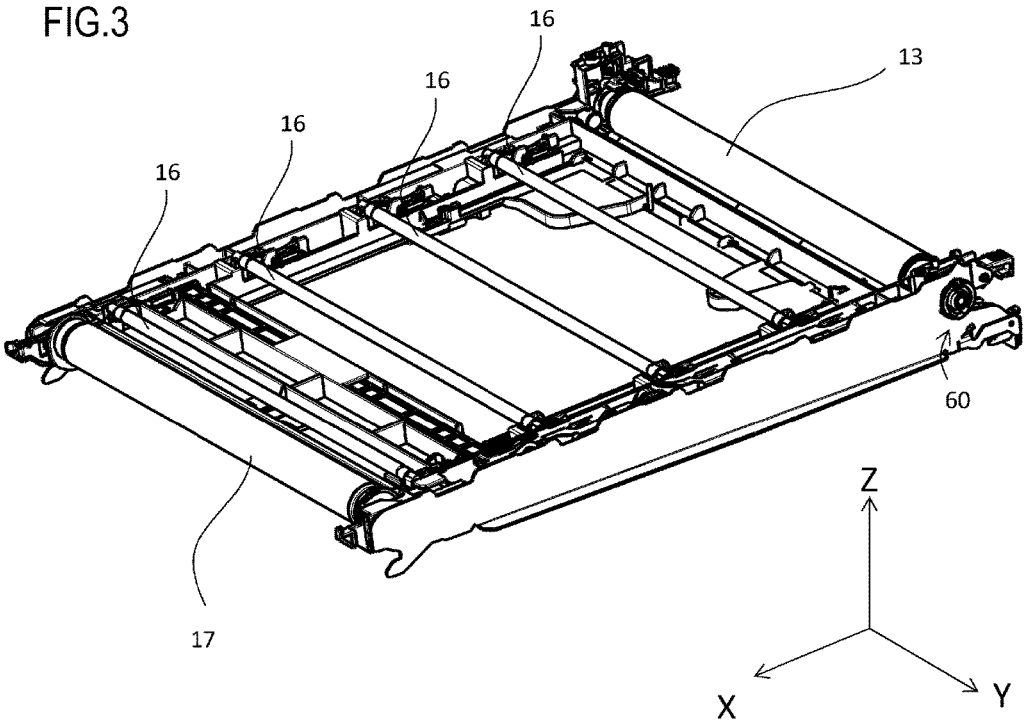
FIG. 3 is a perspective view showing an example of an intermediate transfer belt unit according to the present invention.

FIG. 3 is a perspective view showing an example of the intermediate transfer belt unit 11. Moreover, in the present diagram, the transfer belt 12 is omitted. A roller-side coupling 60 that constitutes the belt drive transmitting portion 50 is provided at one end of the driver roller 13. Hereinafter, details of the belt drive transmitting portion 50 will be described.

Figure 4:
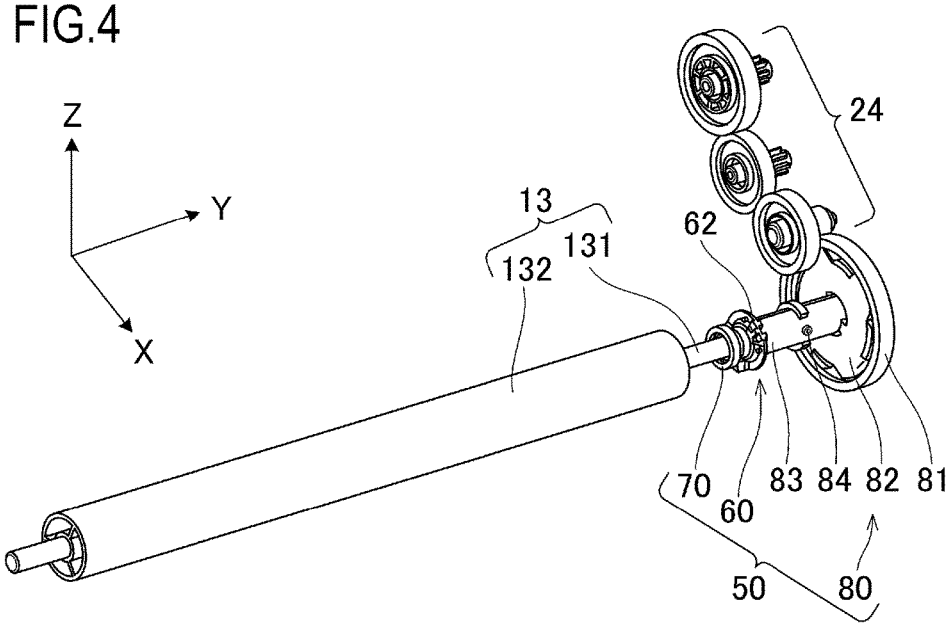
FIG. 4 is a perspective view showing a configuration of a driver roller and a belt drive transmitting portion.

FIG. 4 is a perspective view showing a configuration of the driver roller 13 and the belt drive transmitting portion 50. The belt drive transmitting portion 50 according to the present embodiment is constituted by the roller-side coupling 60 provided on the driver roller 13, a bearing 70, and a drive input-side coupling 80 (to be described later) which is provided on a side of a driving source (not shown) and which is rotated by a driving force from the driving source. Moreover, in the present embodiment, a side on which the drive input-side coupling 80 is arranged can be considered a transmitting portion that transmits a driving force, and a side on which the roller-side coupling 60 is arranged can be considered a receiving portion that receives the driving force.

The drive input-side coupling 80 is constituted by a drive transmitting gear 81, a drive transmitting plate 82, and a metal plate cylindrical shaft 83 that is a metallic drive transmitting member (a cylindrical shaft). Although details will be described later, a driving force from the driving source is transmitted in the order of the drive transmitting gear 81, the drive transmitting plate 82, and the metal plate cylindrical shaft 83. Moreover, a drive transmitting mechanism 24 is provided between the driving source and the drive transmitting gear 81.

Although details will be described later, the roller-side coupling 60 is configured to engage with the metal plate cylindrical shaft 83, and a driving force of the metal plate cylindrical shaft 83 is transmitted to the roller-side coupling 60. The driver roller 13 includes a shaft 131 (an example of the shaft member) formed in a columnar shape and a contact portion 132 which is cylindrically formed on an outer circumferential surface side of the shaft 131 and which is arranged so as to come into contact with an inner circumferential surface of the transfer belt 12. In addition, the roller-side coupling 60 is arranged on a side of one end of the shaft 131 and transmits a driving force from a side of the driving source to the shaft 131. Furthermore, in the present embodiment, the bearing 70 is provided in a different member (not shown) in the intermediate transfer belt unit 11, and the roller-side coupling 60 restricts movement of the shaft 131 in an axial direction and towards a side of the contact portion 132.

Method of Creating Metal Plate Cylindrical Shaft

A manufacturing method of the metal plate cylindrical shaft 83 will now be described in detail with reference to FIGS. 5 to 8. The metal plate cylindrical shaft 83 is a press-worked article produced by applying a bending process to a metal plate and forming the metal plate into a cylindrical shape.

Figure 5:
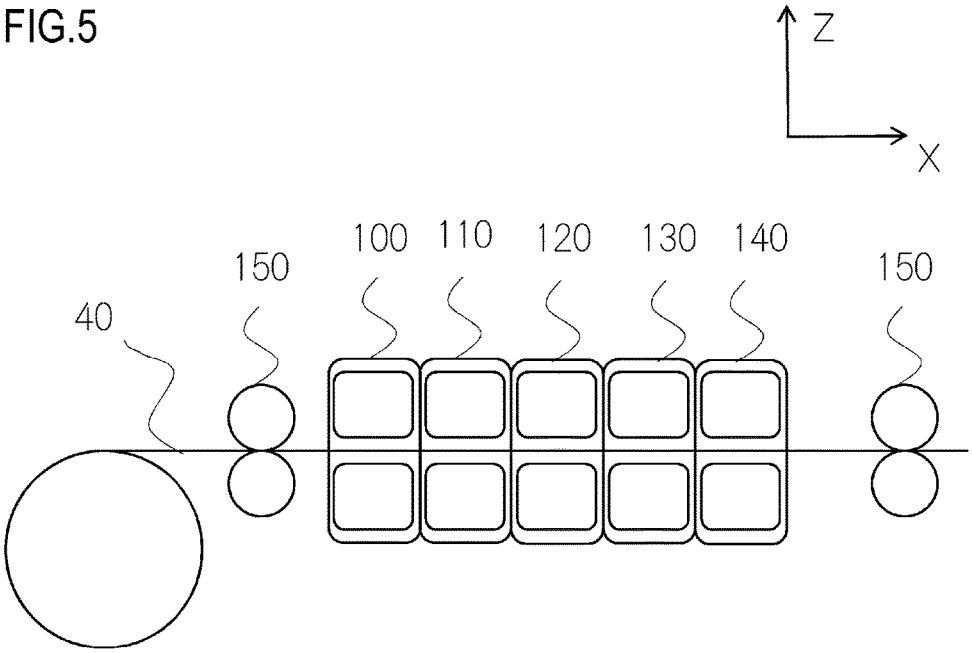
FIG. 5 is a schematic diagram showing a fabrication process of a metal plate cylindrical shaft and an apparatus configuration of a manufacturing apparatus.

FIG. 5 is a schematic diagram showing an apparatus configuration of a manufacturing apparatus of the metal plate cylindrical shaft 83. The manufacturing apparatus of the metal plate cylindrical shaft 83 includes a transporting mechanism 150 that transports a metal plate 40, a punching stage 100 for punching the metal plate 40, bending stages 110, 120, and 130 for performing a bending process, and a cutting stage 140 for performing cutting in which parts are separated. The metal plate 40 having a plate thickness of around 0.4 to 1.2 mm and wound in a coil is unwound by the transporting mechanism 150 and sent to the punching stage 100. The punching stage 100 includes a male mold and a female mold for punching. In the punching stage 100, by pressing the metal plate 40 with the male mold and the female mold, unnecessary portions are cut away from the metal plate 40 and removed and the metal plate 40 is formed into a prescribed pre-bending shape.

Figure 6:
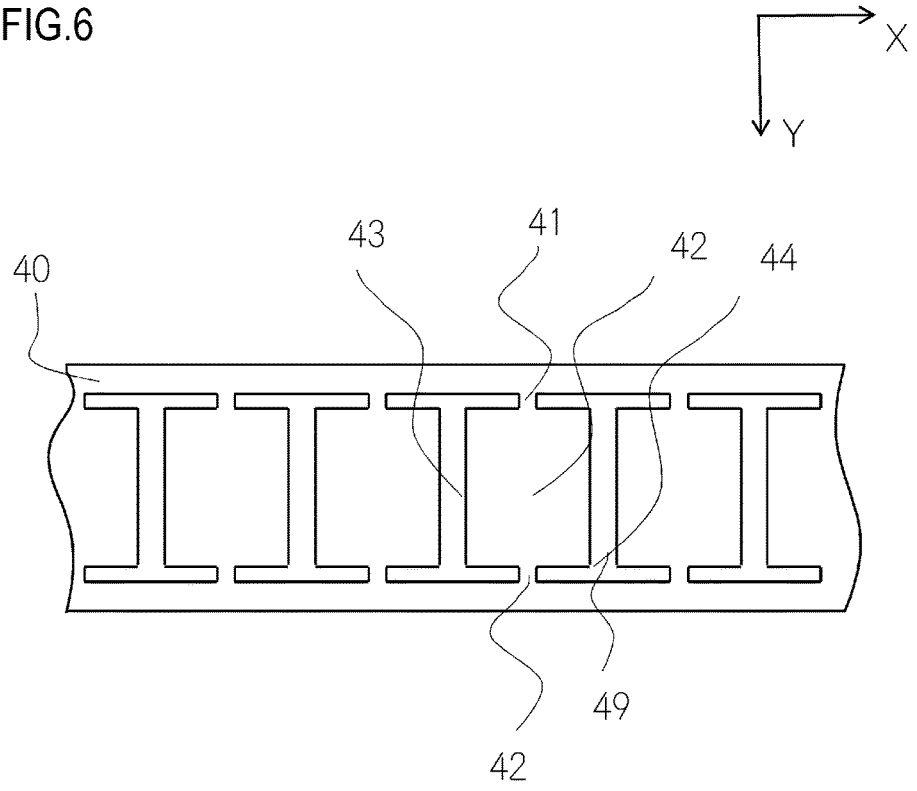
FIG. 6 is a schematic diagram showing a shape of a metal plate after punching.

FIG. 6 is a schematic diagram showing a shape of the metal plate 40 after passing the punching stage 100. A cut shape 49 that is an I-shaped hole or a sideways H-shaped hole is cut out at a plurality of locations at equal intervals from the metal plate 40. Although a notched portion to become a recessed groove for performing delivery of a driving force and a hole to become a through hole in a final form of the metal plate cylindrical shaft 83 are actually formed in the cut shape 49, such details are omitted from the present diagram which represents a schematic view. In addition, due to the punching, the metal plate 40 is processed into a shape in which a plurality of flat plate portions 42 to become the metal plate cylindrical shaft 83 are connected to a frame portion via connecting portions 41. Edge portions 43 and 44 being both ends of the flat plate portion 42 in a transport direction (an X direction) of the metal plate 40 are portions which, when the flat plate portion 42 is formed into a cylindrical portion in a subsequent bending process, become seam portions of the cylindrical portion. In addition, the connecting portion 41 is cut when the flat plate portion 42 is bent into the cylindrical portion and separated from the frame portion. As the metal plate 40 is subjected to consecutive punching by the punching stage 100, the shape described above is formed in plurality at equal intervals in the transport direction.

Bending will be described with reference to FIGS. 7A to 7D. FIGS. 7A to 7D are schematic diagrams illustrating the bending process. The bending stages 110 to 130 shown in FIG. 5 are provided side by side in the transport direction (the X direction) of the metal plate 40.

Figure 7A:
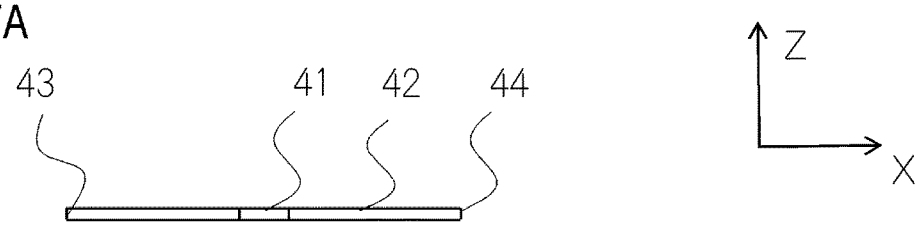
FIGS. 7A to 7D are schematic diagrams showing a bending process of a metal plate cylindrical shaft.

FIG. 7A is a sectional view of one of the flat plate portions 42 of the punched metal plate 40 as seen from a Y direction. Three bending processes are performed in stages with respect to the flat plate portion 42 by the bending stages 110 to 130.

Figure 7B:
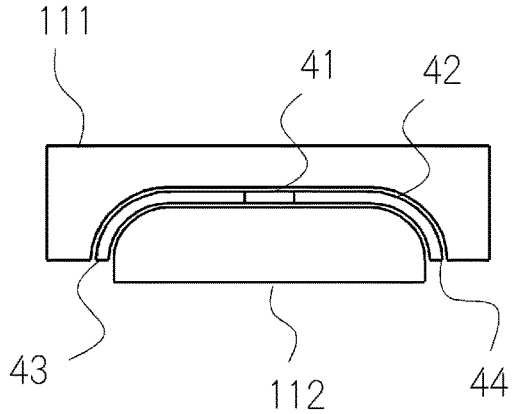

FIG. 7B is a schematic diagram showing a first bending process. The first bending process is performed at the bending stage 110. The bending stage 110 includes a female mold 111 and a male mold 112. By being sandwiched between the female mold 111 and the male mold 112, both side portions of the flat plate portion 42 are bent relative to a central portion so that end surfaces of the edge portions 43 and 44 face downward.

Figure 7C:
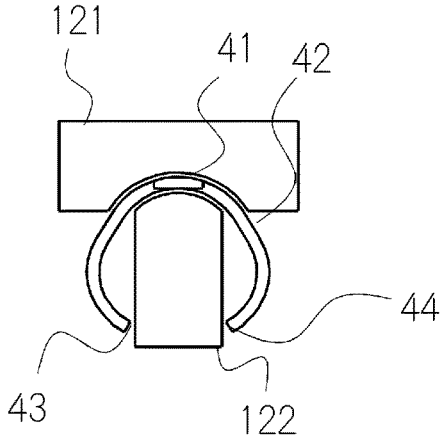

FIG. 7C is a schematic diagram showing a second bending process. The second bending process is performed at the bending stage 120. The bending stage 120 includes a female mold 121 and a male mold 122. A bending process is performed in which the central portion of the flat plate portion 42 bent in the first process is inflected by the female mold 121 and the male mold 122.

Figure 7D:
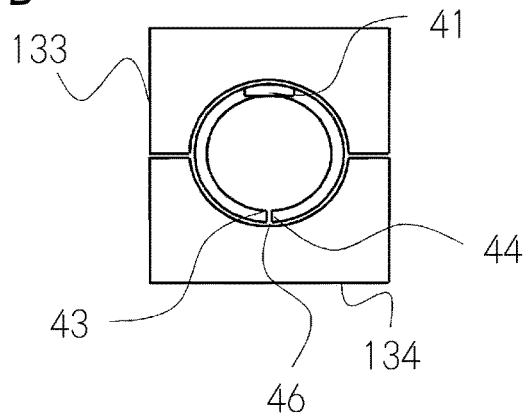

FIG. 7D is a schematic diagram showing a third bending process. The third bending process is performed at the bending stage 130. The bending stage 130 includes a female mold 133 and a male mold 134. The flat plate portion 42 bent in the second process is now bent so as to acquire an overall approximately cylindrical shape and worked so that the edge portion 43 and the edge portion 44 are joined by the female mold 133 and the male mold 134. Due to a seam portion 46 formed by bringing the edge portions 43 and 44 in proximity with each other, the bent flat plate portion 42 acquires an approximately cylindrically connected shape.

Modes of the seam portion 46 include not only a mode in which the edge portions 43 and 44 abut with each other but also a mode in which the edge portions 43 and 44 oppose each other in a circumferential direction across a gap or, in other words, a mode in which the seam portion 46 does not completely join the cylindrical portion. After the bending process described above is completed, the metal plate 40 is in a state where a plurality of the metal plate cylindrical shafts 83 are connected to the frame portion by the connecting portions 41. In addition, after the metal plate cylindrical shaft 83 is formed into a cylindrical shape, the connecting portion 41 is severed at the cutting stage 140 and the metal plate cylindrical shaft 83 is formed into a final form.

Figure 8A:
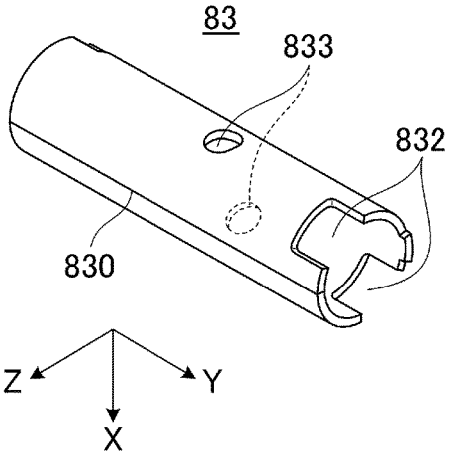
FIGS. 8A and 8B are diagrams showing a final shape of a metal plate cylindrical shaft according to a first embodiment.
Figure 8B:
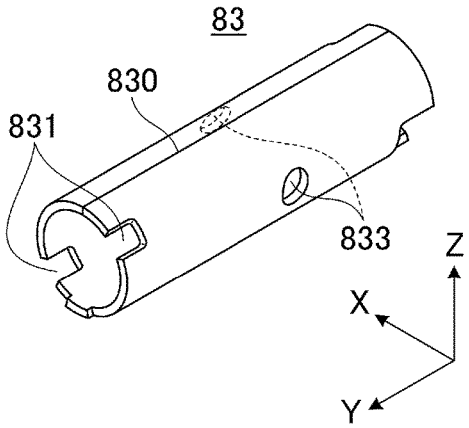
Figure 9A:
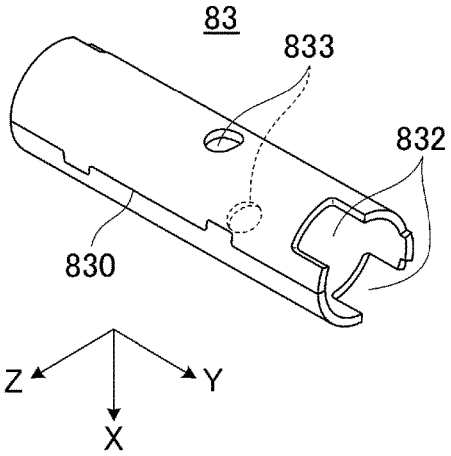
FIGS. 9A and 9B are diagrams showing another shape of a metal plate cylindrical shaft.
Figure 9B:
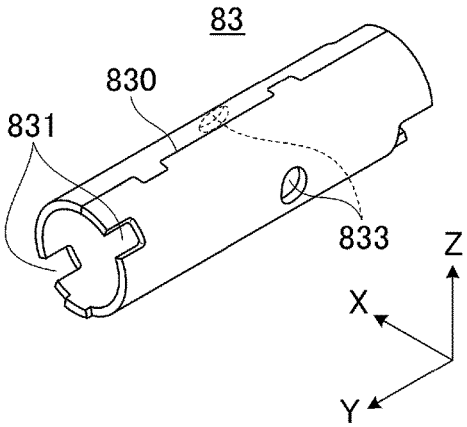

FIGS. 8A and 8B show the metal plate cylindrical shaft 83 in its final form according to the first embodiment. The metal plate cylindrical shaft 83 fabricated by the process described above has, as a seam 830, a pair of circumferential ends which oppose or abut with each other in the circumferential direction from one end to another end in the axial direction. While the seam 830 has a linear shape in the present embodiment, as shown in FIGS. 9A and 9B, a configuration may be adopted in which a recessed shape that is recessed in the circumferential direction is provided at one end and a protruded shape that protrudes in the circumferential direction is provided at the other end opposing the one end and the recessed shape and the protruded shape fit each other.

Accordingly, a deviation in the axial direction of both end surfaces of the seam 830 can be suppressed.

Moreover, an angle between an end surface and a side surface in a protruding direction of the protruded shape and an angle between an end surface and a side surface in a recessing direction of the recessed shape provided on the end surfaces of the seam 830 are set at an approximately right angle in consideration of easiness of bending. Alternatively, the angles may be formed as obtuse angles (smaller than 180 degrees). In other words, the protruded portion may be given a tapered shape in which the closer to a tip, the narrower a width in the axial direction, and the recessed portion may be given a flared shape in which the closer to an opening side, the wider a width in the axial direction (the closer to a bottom side, the narrower the width in the axial direction). Alternatively, a combination of the recessed shape and the protruded shape can be provided in plurality or the protruded shape and the recessed shape can be alternately arranged on one end.

In addition, as a notched portion that is recessed in the axial direction on an approximately annular end surface at an end in the axial direction, the metal plate cylindrical shaft 83 includes a recessed groove 831 and a recessed groove 832. Although details will be given later, the recessed groove 831 and the recessed groove 832 are to respectively constitute a driving force delivery portion with the roller-side coupling 60 and the drive transmitting plate 82.

Drive Input-Side Coupling

Figure 10:
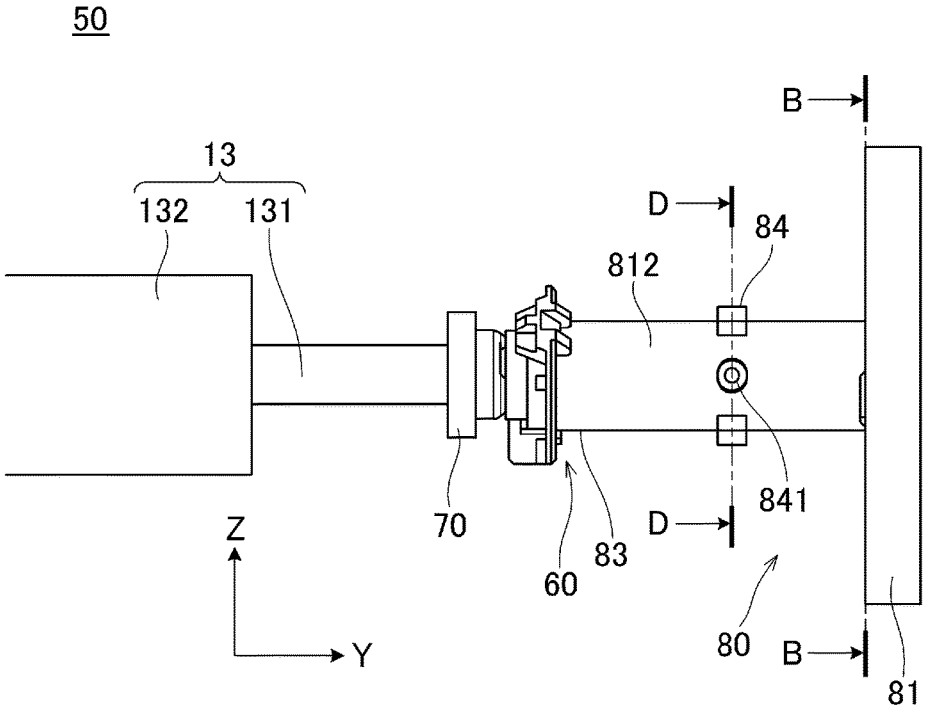
FIG. 10 is a diagram showing a configuration of a belt drive transmitting portion.
Figure 11:
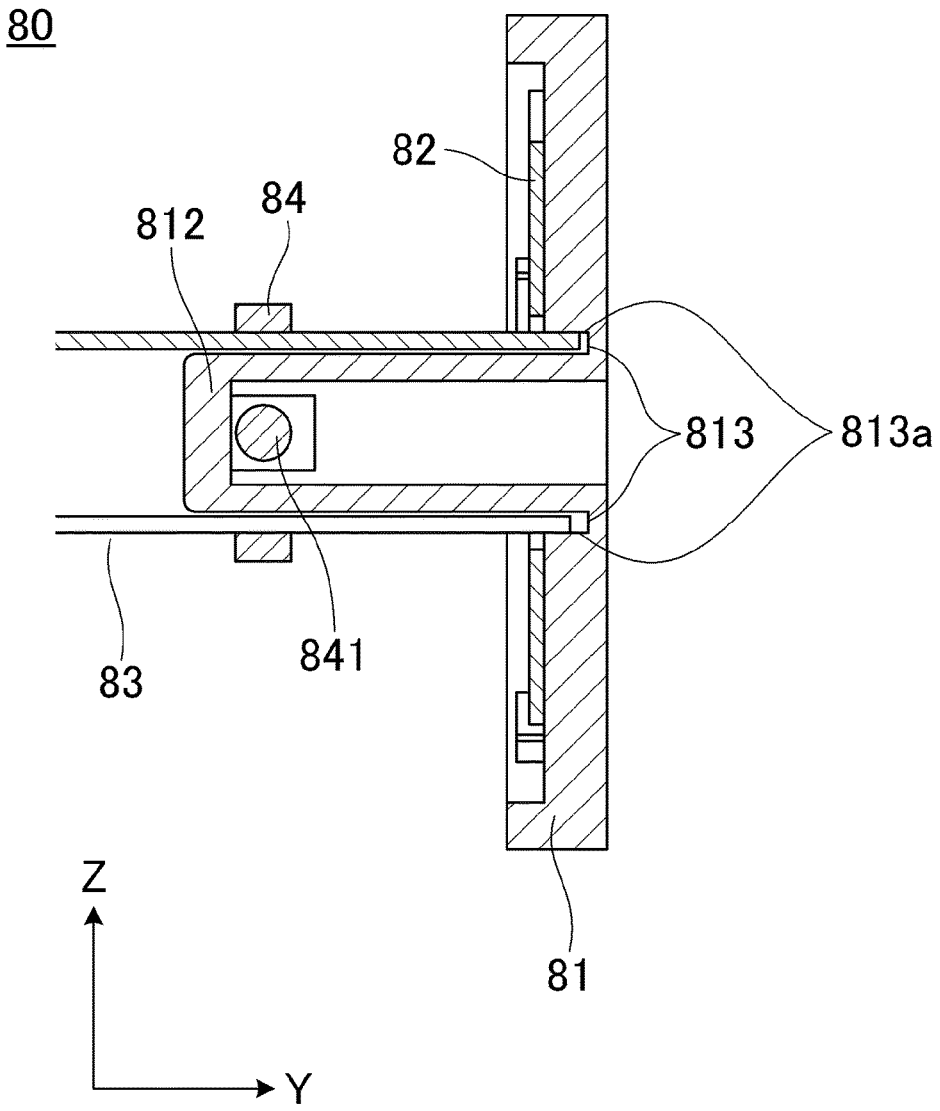
FIG. 11 is a sectional view showing a configuration of a drive input-side coupling according to the first embodiment.
Figure 12:
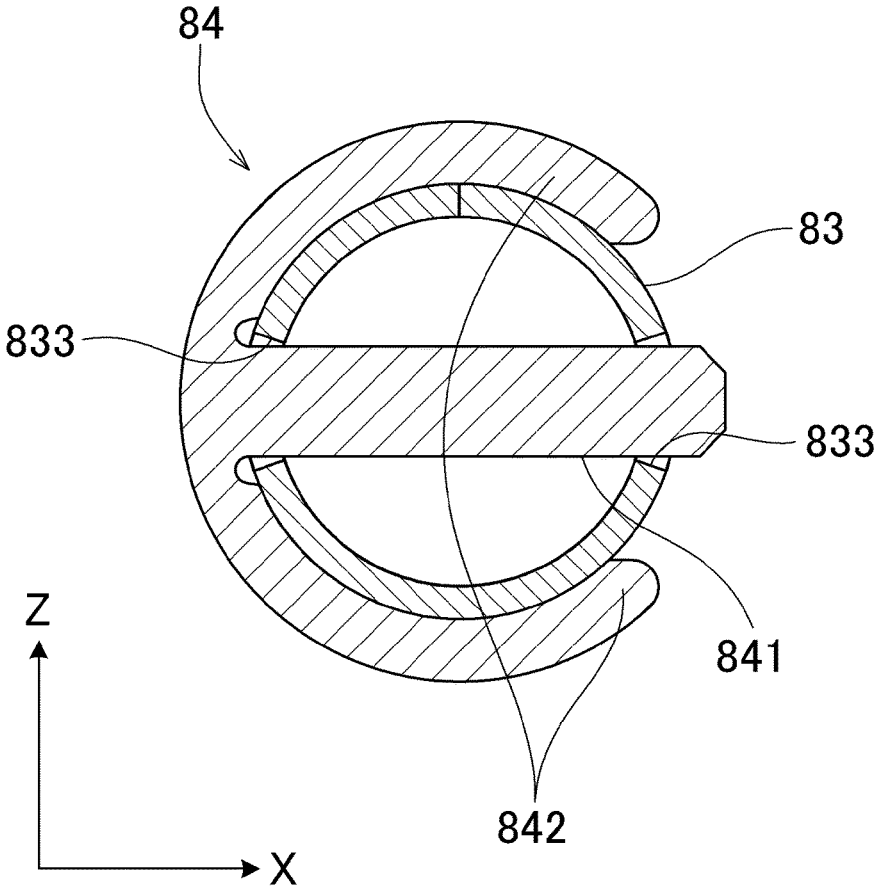
FIG. 12 is a sectional view taken along D-D of a drive-side coupling according to the first embodiment.
Figure 13:
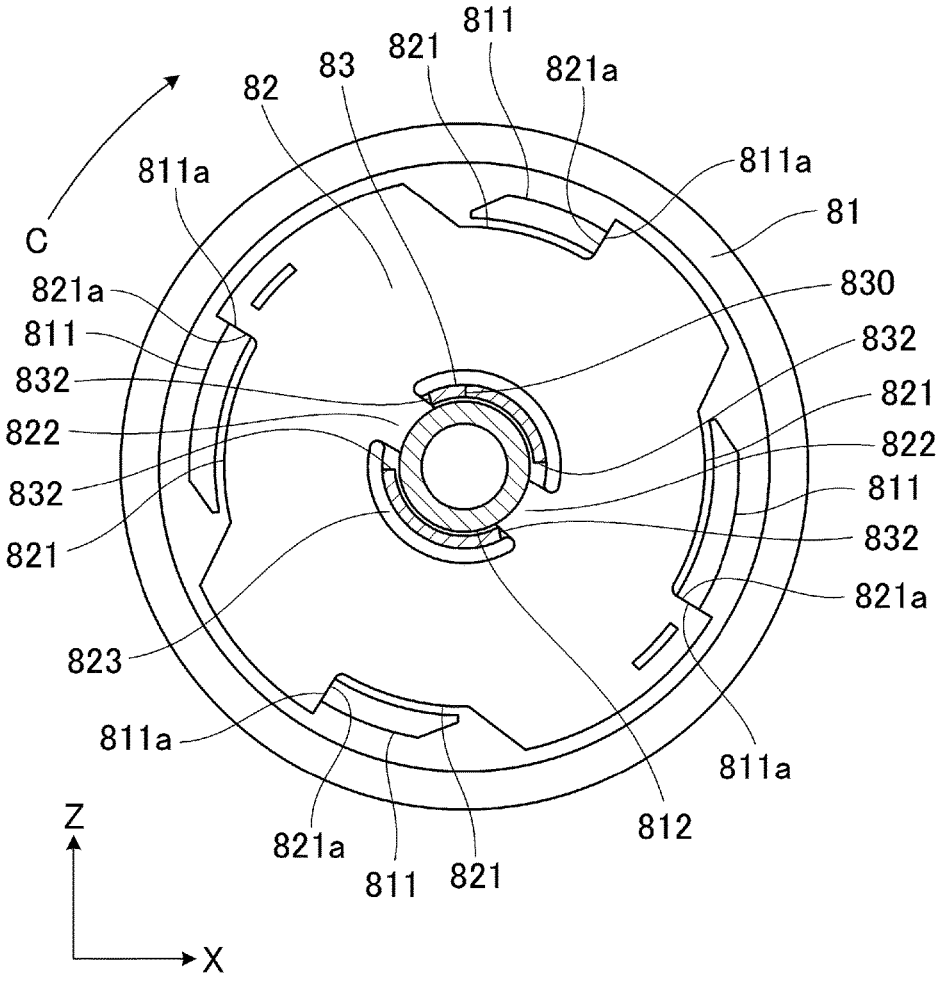
FIG. 13 is a sectional view taken along B-B of the drive-side coupling according to the first embodiment.

A configuration of the drive input-side coupling 80 will be described with reference to FIGS. 10 to 13. FIG. 10 is a diagram showing a configuration of the belt drive transmitting portion 50 as viewed from the front of the main body. FIG. 11 is a sectional view of the drive input-side coupling 80 passing through a center of the metal plate cylindrical shaft 83 as viewed from a same direction as FIG. 10. FIG. 12 shows a cross section taken along line D-D in FIG. 10. FIG. 13 shows a cross section taken along line B-B in FIG. 10.

As described earlier, the drive input-side coupling 80 is provided on a side of the driving source (not shown) in the belt drive transmitting portion 50, and the drive transmitting gear 81 receives a driving force (a rotating force) from the drive transmitting mechanism 24 and transmits the driving force to the metal plate cylindrical shaft 83 via the drive transmitting plate 82.

As shown in FIG. 11, a shaft-like central projecting portion 812 is provided at a center of the drive transmitting gear 81 and a groove 813 is provided at a base of the central projecting portion 812. In this case, as shown in FIGS. 11 and 13, since the central projecting portion 812 is to be inserted to an inner circumferential portion of the metal plate cylindrical shaft 83, the metal plate cylindrical shaft 83 is configured such that an inner circumferential diameter thereof is larger than an outer circumferential diameter of the central projecting portion 812. In addition, an inner circumferential surface 813*a* that is an inner surface of the groove 813 on an outer side in the radial direction is configured such that an outer circumferential surface of the metal plate cylindrical shaft 83 comes into fitting contact therewith.

Furthermore, the metal plate cylindrical shaft 83 is provided with an approximately circular through-hole 833 and, due to a stopper 84 being attached so as to penetrate the metal plate cylindrical shaft 83 and the projecting portion 812, positions of the drive transmitting gear 81 and the metal plate cylindrical shaft 83 in the axial direction are restricted. FIG. 13 shows a state where the stopper 84 is inserted into the through-hole 833 and penetrates the central projecting portion 812 of the drive transmitting gear 81 and the metal plate cylindrical shaft 83. The stopper 84 according to the present embodiment is formed of a resin material and is constituted by, as shown in FIG. 12, a shaft portion 841 penetrating the through-hole 833 of the metal plate cylindrical shaft 83 and an arm portion 842 formed so as to conform to an outer shape of the metal plate cylindrical shaft 83. The arm portion 842 is configured to be attachable to the metal plate cylindrical shaft 83 by coming into contact with the outer circumference of the metal plate cylindrical shaft 83 and deforming so as to open.

In addition, by attaching the metal plate cylindrical shaft 83 so that the outer circumferential surface of the metal plate cylindrical shaft 83 comes into fitting contact with the inner circumferential surface 813*a* of the groove 813, a central axis of the drive transmitting gear 81 and a central axis of the metal plate cylindrical shaft 83 are made to coincide with each other. Accordingly, unevenness in rotation of the metal plate cylindrical shaft 83 is reduced and drive transmission with high accuracy can be realized. Moreover, while the outer circumferential surface of the metal plate cylindrical shaft 83 and the inner circumferential surface 813*a* of the groove 813 of which dimensional accuracy is readily attainable when machining the metal plate cylindrical shaft are brought into fitting contact with each other in the present embodiment, this configuration is not restrictive. For example, the central axis of the drive transmitting gear 81 and the central axis of the metal plate cylindrical shaft 83 can be made to coincide with each other by bringing an inner circumferential surface of the metal plate cylindrical shaft 83 and an outer circumferential surface of the central projecting portion 812 into fitting contact with each other.

As shown in FIG. 13, one or a plurality of projecting portions 811 are provided on a same circumference at a predetermined distance from a center of a gear pitch circle in a side surface portion of the drive transmitting gear 81. A drive transmitting surface 811*a* is provided on a forward side in a rotation direction C of the drive transmitting gear 81 on the projecting portion 811. Meanwhile, the drive transmitting plate 82 is a plate with a shape approximately resembling a shuriken (a ninja star) having one or a plurality of notches 821 with respect to an outermost circumferential surface of a circle. The notch 821 is provided on a forward side in a rotation direction in the notch with a drive-transmitted surface 821*a* configured to come into contact in a circumferential direction with the drive transmitting surface 811*a* of the projecting portion 811 provided on the drive transmitting gear 81. A contact surface of the drive transmitting surface 811*a* and the drive-transmitted surface 821*a* is positioned on a line connecting an arbitrary point on a circumference of the gear and a center of the gear. Accordingly, an orientation of a force applied at the contact surface can be made to coincide with the rotation direction and drive transmission loss can be suppressed.

An approximately circular hole 823 is provided at a central portion of the drive transmitting plate 82, and one or a plurality of protruded portions 822 are provided so as to protrude toward the center (inward in a radial direction) from an inner circumferential surface of the hole 823. Moreover, a position of the drive transmitting plate 82 in the Y direction is restricted in one direction by colliding with a side surface of the drive transmitting gear 81 and restricted in an opposite direction by a restricting member (not shown) provided so as to engage with the metal plate cylindrical shaft 83. While the recessed groove 832 is provided at an end of the metal plate cylindrical shaft 83 on the side of the drive transmitting gear 81, as shown in FIG. 13, a width of the recessed groove 832 in a circumferential direction is configured to be larger than a width in a circumferential direction of the protruded portion 822 in the drive transmitting plate 82. In addition, an outer circumferential diameter of the metal plate cylindrical shaft 83 is configured to be smaller than a diameter of the hole 823 provided at the central portion of the drive transmitting plate 82.

Details of drive transmission from the drive transmitting gear 81 to the metal plate cylindrical shaft 83 will now be described. First, drive transmission from the drive transmitting gear 81 to the drive transmitting plate 82 is performed between the drive transmitting surface 811*a* of the drive transmitting gear 81 and the drive-transmitted surface 821*a* of the drive transmitting plate 82 which abut with each other in the circumferential direction. In this case, since the contact surface of the drive transmitting surface 811*a* and the drive-transmitted surface 821*a* is provided at a predetermined distance from the center of the drive transmitting gear 81, a force applied to the contact surface in accordance with a distance from the gear center can be reduced with respect to on-axis torque. In addition, by providing the drive transmitting surface 811*a* and the drive-transmitted surface 821*a* in plurality, an applied load per one location of the drive transmitting surface 811*a* on the gear can be distributed in accordance with the number of the provided surfaces.

Figure 14:
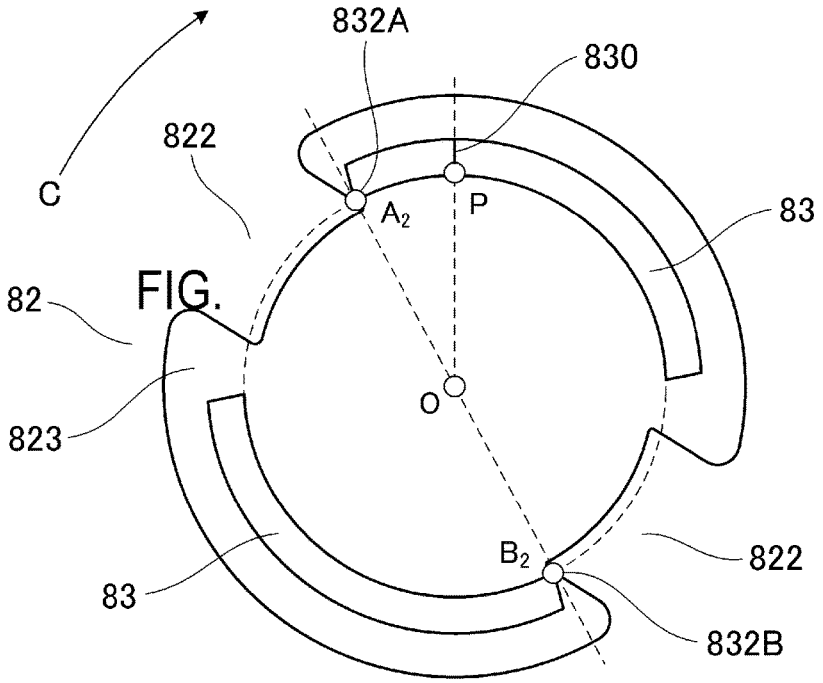
FIG. 14 is a sectional view showing a positional relationship between a drive receiving surface and a seam of the metal plate cylindrical shaft according to the first embodiment.

As shown in FIG. 14, drive transmission from the drive transmitting plate 82 as the first member to the metal plate cylindrical shaft 83 is performed at a contact portion between the protruded portion 822 of the drive transmitting plate 82 and the recessed groove 832 provided at one end of the metal plate cylindrical shaft 83. The contact portion of the recessed groove 832 with the protruded portion 822 corresponds to the force receiving portion according to the present invention.

In the contact portion between the protruded portion 822 of the drive transmitting plate 82 and the recessed groove 832 of the metal plate cylindrical shaft 83, let 832A denote a contact point nearest to the seam 830 of the metal plate cylindrical shaft 83 in an opposite direction to the rotation direction C of the metal plate cylindrical shaft 83. The contact portion of the recessed groove 832 with the protruded portion 822 corresponding to the contact point 832A corresponds to the first force receiving portion according to the present invention. In the recessed groove 832, a portion corresponding to the contact point 832A is a portion that receives force in the circumferential direction from the protruded portion 822 of the drive transmitting plate 82 and is a contact portion nearest to the seam 830 in an opposite direction to a direction in which the force is received. In addition, let 832B denote a contact point nearest to the seam 830 in the rotation direction of the metal plate cylindrical shaft 83. The contact portion of the recessed groove 832 with the protruded portion 322 corresponding to the contact point 832B corresponds to the second force receiving portion according to the present invention. In the recessed groove 832, a portion corresponding to the contact point 832B is a contact portion nearest to the seam 830 in the direction in which the force is received.

In the present embodiment, two recessed grooves 832 are provided as force-receiving notched portions. One recessed groove 832 (the first notched portion) is provided at a position nearest to the seam 830 in the opposite direction to the rotation direction C (the direction in which a force is received from the protruded portion 822) of the metal plate cylindrical shaft 83. A contact portion in the one recessed groove 832 (the first notched portion) with the protruded portion 822 corresponds to the contact point 832A. In addition, the other recessed groove 832 (the second notched portion) is provided at a position nearest to the seam 830 in the rotation direction C (the direction in which a force is received from the protruded portion 822) of the metal plate cylindrical shaft 83. A contact portion in the other recessed groove 832 (the second notched portion) with the protruded portion 822 corresponds to the contact point 832B. The other recessed groove 832 (the second notched portion) is at a position farther from the seam 830 in the circumferential direction than the one recessed groove 832 (the first notched portion).

FIG. 14 is a partial sectional view through the contact points 832A and 832B of the metal plate cylindrical shaft 83 and the drive transmitting plate 82 in a same direction as FIG. 13. FIG. 14 shows a positional relationship between the contact points 832A and 832B that are drive transmission points between the metal plate cylindrical shaft 83 and the drive transmitting plate 82 and the seam 830 of the metal plate cylindrical shaft 83. In FIG. 14, a point O denotes a center (a rotational center) of the metal plate cylindrical shaft, a point P denotes an intersection of the seam 830 and the inner circumferential surface of the metal plate cylindrical shaft 83, and points $A_2$ and $B_2$ respectively denote the contact points 832A and 832B on the sectional view. Moreover, the metal plate cylindrical shaft 83 according to the present embodiment is worked into a cylindrical shape by bending after performing a punching process on a metal plate. Therefore, the end surfaces of the recessed grooves 831 and 832, the end surface of the through-hole 833, both ends of the metal plate at the seam 830, and the like tend to become inclined so as to open from an inner circumference toward an outer circumference of the metal plate cylindrical shaft 83 on a plane perpendicular to the axis of the metal plate cylindrical shaft 83. Accordingly, the contact point between the metal plate cylindrical shaft 83 and the drive transmitting plate 82 is on a circumference of the inner circumferential surface of the metal plate cylindrical shaft 83.

As shown in FIG. 14, let $\angle A_2OP$ denote a central angle (the first central angle) of an imaginary arc (the first imaginary arc) which has the rotational center O of the metal plate cylindrical shaft 83 as its center and which connects the contact point 832A of the metal plate cylindrical shaft 83 and the seam 830 in the rotation direction C of the metal plate cylindrical shaft 83. In addition, let $\angle B_2OP$ denote a central angle (the second central angle) of an imaginary arc (the second imaginary arc) which has the rotational center O of the metal plate cylindrical shaft 83 as its center and which connects the contact point 832B of the metal plate cylindrical shaft 83 and the seam 830 in an opposite direction to the rotation direction C of the metal plate cylindrical shaft 83. In the present embodiment, the respective recessed grooves 832 and the seam 830 are provided at different positions in the circumferential direction when the metal plate cylindrical shaft 83 is viewed in the axial direction so that the first central angle of the first imaginary arc becomes smaller than the second central angle of the second imaginary arc. In other words, in FIG. 14, the respective drive receiving portions (the force receiving portions) or, in other words, the recessed grooves 832 to become contact portions with the drive transmitting plate 82 are provided so that $\angle A_2OP < \angle B_2OP$ is satisfied. Hereinafter, the reason for setting the positional relationship between the seam 830 of the metal plate cylindrical shaft 83 and the drive receiving portion points 832A and 832B as described above will be explained.

Figure 15A:
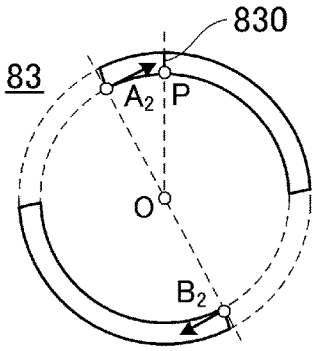
FIGS. 15A to 15C are diagrams showing a positional relationship between a drive receiving surface and a seam of a metal plate cylindrical shaft.
Figure 15B:
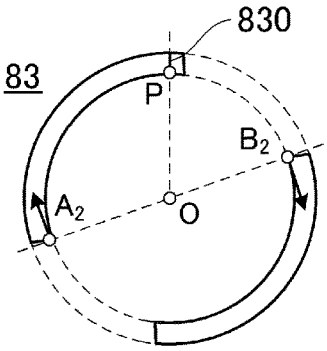
Figure 15C:
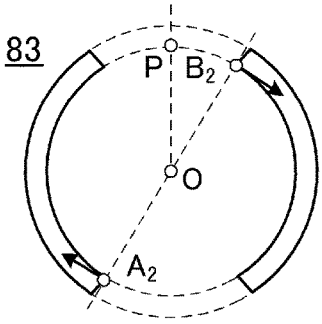

FIGS. 15A to 15C are schematic diagrams showing arrangements of the recessed groove 832 and the seam 830 in the form of a comparison between the arrangement according to the present embodiment and arrangements according to comparative examples. FIG. 15A is a schematic diagram (a diagram as viewed in the axial direction) of the metal plate cylindrical shaft 83 in a case (the present embodiment) in which the drive receiving portions are arranged so as to satisfy $\angle A_2OP<\angle B_2OP$. FIG. 15B is a schematic diagram of the metal plate cylindrical shaft 83 in a case (a first comparative example) in which the drive receiving portions are arranged so as to satisfy $\angle A_2OP>\angle B_2OP$. FIG. 15C is a schematic diagram of the metal plate cylindrical shaft 83 in a case (a second comparative example) in which the recessed grooves 832 are provided on the seam 830 (provided at overlapping positions in the circumferential direction as viewed in the axial direction).

When a driving force is transmitted to the metal plate cylindrical shaft 83 and forces are applied at the contact points $A_2$ and $B_2$, in the arrangement shown in FIG. 15C, the forces are applied in directions that cause the seam 830 to open. In the arrangement shown in FIG. 15B, since the forces act in directions that cause the seam 830 to open and in directions that cause the seam 830 to deviate in a radial direction, torsion of the shaft may possibly increase. Conversely, in the arrangement shown in FIG. 15A, since the forces are applied in directions that cause the seam 830 to close, the seam is prevented from opening. In addition, in the arrangement shown in FIG. 15A, although the forces are also applied in directions causing a deviation of the metal plate cylindrical shaft 83 in the radial direction in a similar manner to FIG. 15B, due to ends of a metal plate coming into contact with each other at the seam 830, the forces applied in directions causing the seam 830 to close become forces that push the ends of the metal plate of the seam 830 against each other. Accordingly, a friction force between the ends of the metal plate of the seam 830 increases and a deviation of the metal plate cylindrical shaft 83 in the radial direction can be suppressed.

Therefore, the present embodiment adopts the configuration shown in FIG. 15A in which the seam 830 is less likely to open and a deviation of the metal plate cylindrical shaft 83 in the radial direction is less likely to occur. In addition, by arranging the recessed grooves 832 in this manner, the seam 830 of the metal plate cylindrical shaft 83 is prevented from opening or deviating and a torsional strength of the metal plate cylindrical shaft 83 is prevented from declining. Moreover, while a configuration in which $\angle A_2OP$ is an acute angle and $\angle B_2OP$ is an obtuse angle is adopted in the present embodiment, this configuration is not restrictive. For example, a configuration in which $\angle B_2OP$ is an approximately right angle can be appropriately adopted as long as the effect described above is produced.

In addition, a deviation of the ends of a metal plate at the seam 830 in the axial direction of the metal plate cylindrical shaft 83 can be suppressed by providing the seam 830 with a recessed shape and a protruded shape and causing the recessed shape and the protruded shape to fit with each other as shown in FIGS. 9A and 9B.

Drive Transmitting-Side Coupling

Figure 16:
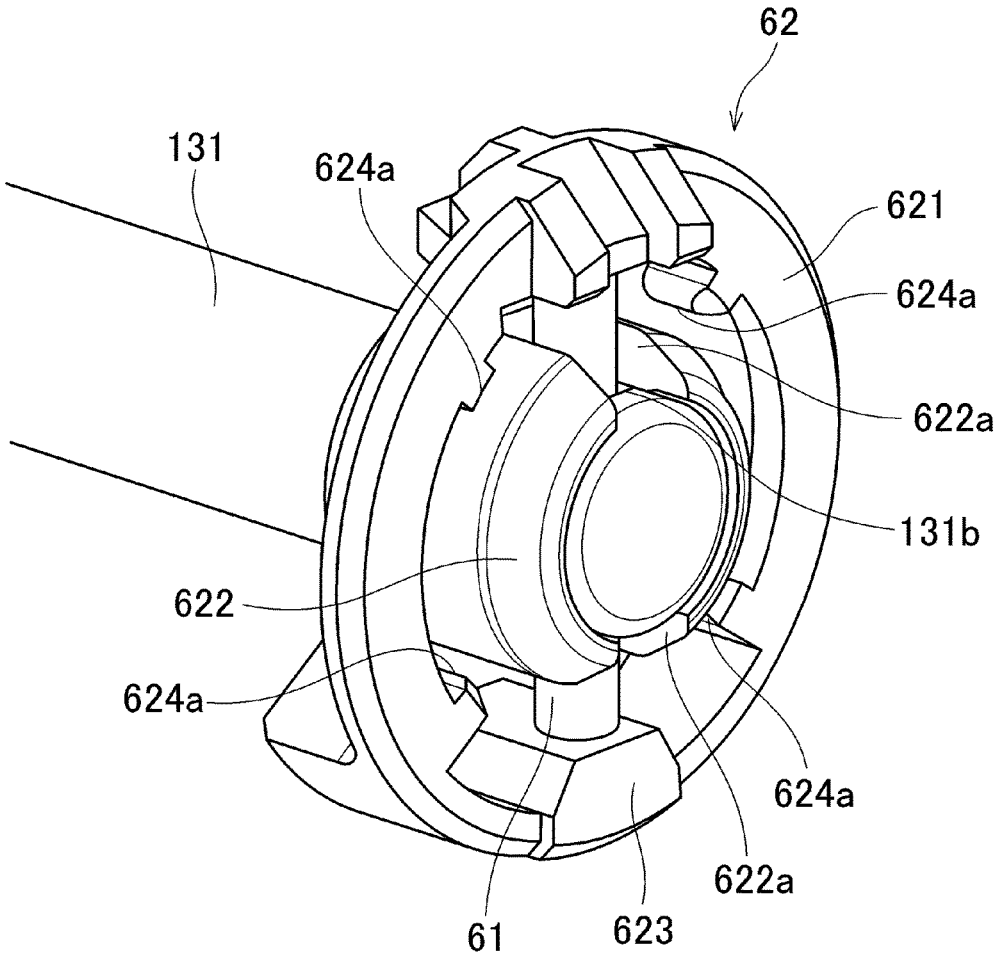
FIG. 16 is a diagram showing a configuration of a drive transmitting-side coupling according to the first embodiment.

The roller-side coupling 60 will now be described with reference to FIG. 16. FIG. 16 is a schematic perspective view for describing the roller-side coupling 60. The roller-side coupling 60 according to the present embodiment includes a pin 61 to be inserted to a through-hole 131*b* formed on the shaft 131 and a resin cover member 62 to be attached to the shaft 131. In addition, although not shown in FIG. 16, the roller-side coupling 60 also includes the bearing 70 (refer to FIG. 4). The cover member 62 is formed in an approximately double annular shape and includes an outer ring portion 621 (the second annular portion), an inner ring portion 622 (the first annular portion), and a base portion 623 (the coupling portion) that connects the outer ring portion and the inner ring portion with each other. Recessed grooves 622*a* as engaging portions capable of engaging with the pin 61 in a rotation direction are formed in the inner ring portion 622 at two positions opposing a center of the inner ring.

The pin 61 as an example of a delivery member and an inserted member is formed in a columnar shape and is inserted to the through-hole 131*b* formed on the shaft 131 in a non-press-fitted state and arranged in a state where the both ends of the pin 61 protrude from the outer circumferential surface of the shaft 131. Both protruding ends of the pin 61 are restricted by the resin cover member 62, and the resin cover member 62 also restricts movement of the pin 61 in a thrust direction in the through-hole.

Figure 17:
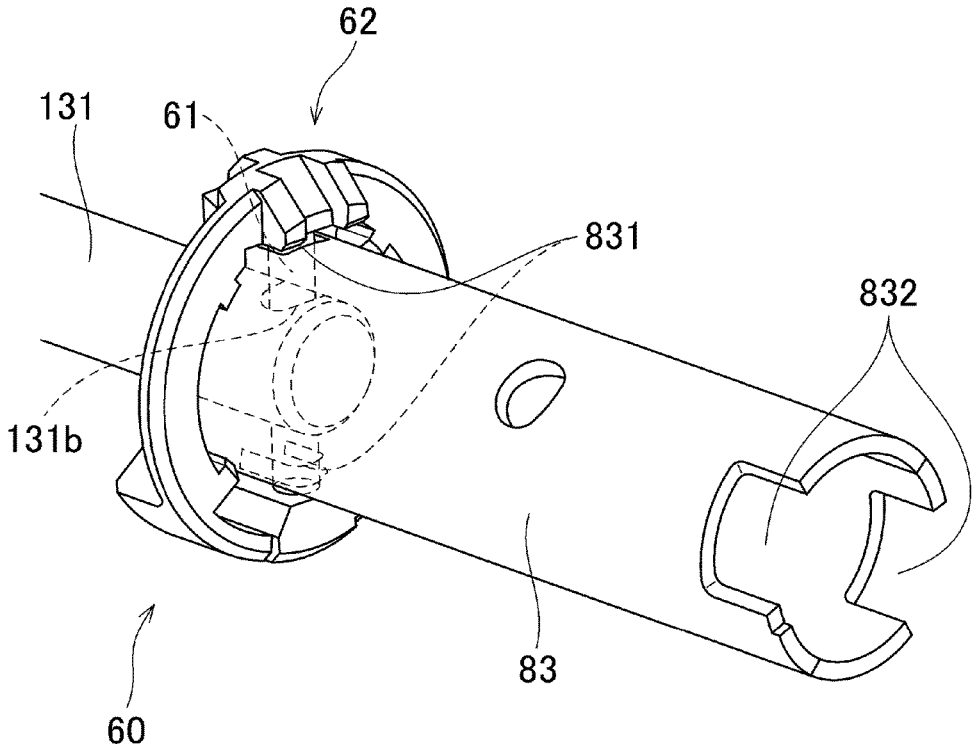
FIG. 17 is a diagram showing an engagement between the drive transmitting-side coupling and the metal plate cylindrical shaft according to the first embodiment.

FIG. 17 shows how the roller-side coupling 60 engages with the metal plate cylindrical shaft 83. The pin 61 is configured so as to engage with the metal plate cylindrical shaft 83. The recessed grooves 831 at two locations as notched portions provided on the metal plate cylindrical shaft 83 are arranged so as to hold the pin 61, and drive is transmitted from the metal plate cylindrical shaft 83 to the pin 61 as the second member. Therefore, an outer diameter of the pin 61 is configured smaller than a width of the recessed grooves 831. In addition, as drive is transmitted and the pin 61 inserted to the through-hole 131*b* of the shaft 131 rotates, the shaft 131 or, in other words, the driver roller 13 rotates.

Figure 18:
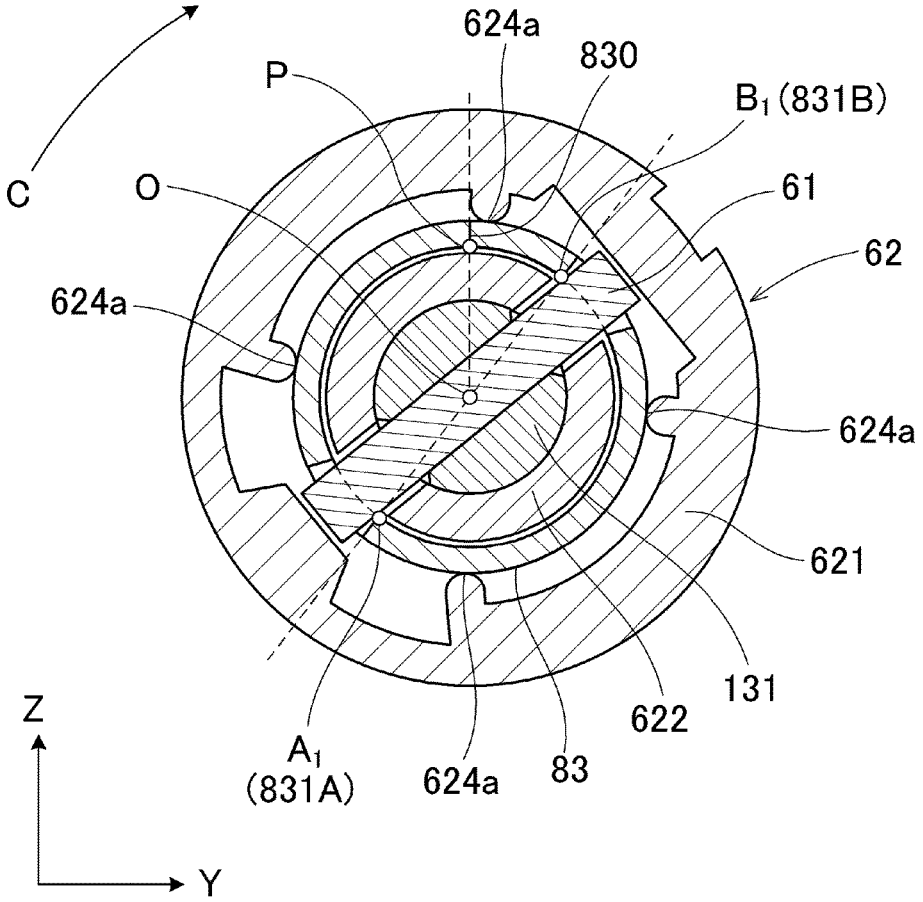
FIG. 18 is a sectional view showing a positional relationship between a drive transmitting surface and the seam of the metal plate cylindrical shaft according to the first embodiment.

As shown in FIG. 18, drive transmission from the metal plate cylindrical shaft 83 to the pin 61 as the second member is performed at a contact portion between the recessed grooves 831 of the metal plate cylindrical shaft 83 and the pin 61. The contact portion of the recessed grooves 831 with the pin 61 corresponds to the force receiving portion as a portion that receives a reaction force from the second member when driving the second member and also corresponds to the force applying portion that causes the driving force received from the first member to act on the second member according to the present invention.

In the contact portion between the recessed grooves 832 of the metal plate cylindrical shaft 83, let 831A denote a contact point nearest to the seam 830 of the metal plate cylindrical shaft 83 in an opposite direction (a direction in which a reaction force is received from the pin 61) to the rotation direction C of the metal plate cylindrical shaft 83. The contact portion of the recessed groove 831 with the pin 61 which corresponds to the contact point 831A corresponds to the second force receiving portion as well as the second force applying portion according to the present invention. In the recessed groove 831, a portion corresponding to the contact point 831A is a portion that receives a reaction force in the circumferential direction from the pin 61 and is a contact portion nearest to the seam 830 in a direction in which the reaction force is received. In addition, let 831B denote a contact point nearest to the seam 830 in the rotation direction C (an opposite direction to the direction in which the reaction force is received from the pin 61) of the metal plate cylindrical shaft 83. The contact portion of the recessed groove 831 with the pin 61 which corresponds to the contact point 831B corresponds to the first force receiving portion as well as the first force applying portion according to the present invention. In the recessed groove 831, a portion corresponding to the contact point 831B is a portion that receives a reaction force from the pin 61 in the circumferential direction and is a contact portion nearest to the seam 830 in the opposite direction to the direction in which the reaction force is received.

In the present embodiment, two recessed grooves 831 are provided as force-applying notched portions. One recessed groove 831 (the first notched portion) is provided at a position nearest to the seam 830 in the rotation direction C (a direction in which a force is applied to the pin 61, and an opposite direction to the direction in which a reaction force is received from the pin 61) of the metal plate cylindrical shaft 83. A contact portion in the one recessed groove 831 (the first notched portion) with the pin 61 corresponds to the contact point 831B. In addition, the other recessed groove 831 (the second notched portion) is provided at a position nearest to the seam 830 in an opposite direction (a direction in which a reaction force is received from the pin 61) to the rotation direction C (a direction in which a force is applied to the pin 61) of the metal plate cylindrical shaft 83. A contact portion in the other recessed groove 831 (the second notched portion) with the pin 61 corresponds to the contact point 831A. The other recessed groove 831 (the second notched portion) is at a position farther from the seam 830 in the circumferential direction than the one recessed groove 831 (the first notched portion).

FIG. 18 is a schematic sectional view showing a positional relationship among the shaft 131, the resin cover member 62, and the metal plate cylindrical shaft 83 as well as a positional relationship between the contact points 831A and 831B that are drive transmission points between the metal plate cylindrical shaft 83 and the pin 61 and the seam 830. FIG. 18 shows a cross section passing through the contact points 831A and 831B of the metal plate cylindrical shaft 83 when viewed from a side of an end where the recessed groove 831 is provided in the axial direction of the metal plate cylindrical shaft 83. In FIG. 18, C denotes the rotation direction of the metal plate cylindrical shaft, a point O denotes a center (a rotational center) of the metal plate cylindrical shaft on the sectional view in FIG. 18, a point P denotes an intersection of a center line of the seam 830 and a circumference of the inner circumferential surface of the metal plate cylindrical shaft 83, and points $A_1$ and $B_1$ respectively denote the contact points 831A and 831B. In the present embodiment, as shown in FIG. 18, an inner circumferential surface of the inner ring portion 622 of the resin cover member 62 is in slidable contact with the shaft 131, and the outer ring portion 621 is provided with a plurality of ribs 624*a* so as to come into fitting contact with the metal plate cylindrical shaft 83. Accordingly, a central axis of the shaft 131 and the central axis of the metal plate cylindrical shaft are made to coincide with each other. Moreover, an outer circumferential surface of the inner ring portion 622 is configured to be smaller than a diameter of the outer circumferential surface of the metal plate cylindrical shaft. In addition, as described earlier, in the metal plate cylindrical shaft 83, the end surfaces of the recessed grooves 831 and 832, both ends of the metal plate at the seam 830, and the like tend to become inclined so as to open from the inner circumference toward the outer circumference of the metal plate cylindrical shaft 83 on a plane perpendicular to the axis of the metal plate cylindrical shaft 83. Accordingly, the contact point between the metal plate cylindrical shaft 83 and the pin 61 is on a circumference of the inner circumferential surface of the metal plate cylindrical shaft 83.

As shown in FIG. 18, let $\angle A_1OP$ denote a central angle (the second central angle) of an imaginary arc (the second imaginary arc) which has the rotational center O of the metal plate cylindrical shaft 83 as its center and which connects the contact point 831A of the metal plate cylindrical shaft 83 and the seam 830 in the rotation direction C of the metal plate cylindrical shaft 83. In addition, let $\angle B_1OP$ denote a central angle (the first central angle) of an imaginary arc (the first imaginary arc) which has the rotational center O of the metal plate cylindrical shaft 83 as its center and which connects the contact point 831B of the metal plate cylindrical shaft 83 and the seam 830 in the opposite direction to the rotation direction C of the metal plate cylindrical shaft 83. In the present embodiment, the respective recessed grooves 831 and the seam 830 are provided at different positions in the circumferential direction when the metal plate cylindrical shaft 83 is viewed in the axial direction so that the first central angle of the first imaginary arc becomes smaller than the second central angle of the second imaginary arc. In other words, in FIG. 18, the respective drive transmitting portions (the force applying portions that are also the force receiving portions) or, in other words, the recessed grooves 831 to become contact portions with the pin 61 are arranged so that $\angle A_1OP > \angle B_1OP$ is satisfied.

Figure 19A:
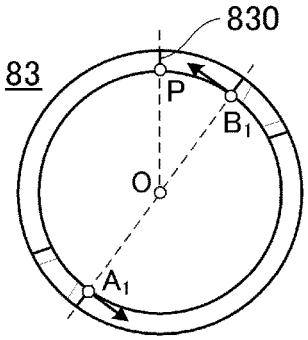
FIGS. 19A to 19C are diagrams showing a positional relationship between a drive transmitting surface and a seam of a metal plate cylindrical shaft.
Figure 19B:
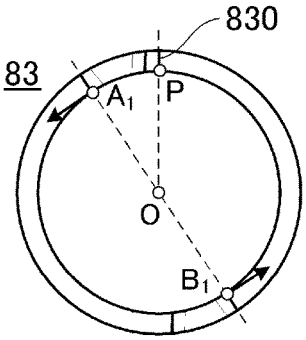
Figure 19C:
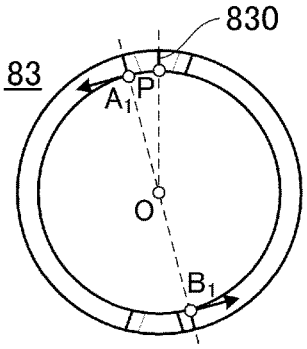

FIGS. 19A to 19C are schematic diagrams showing arrangements of the recessed grooves 831 and the seam 830 in the form of a comparison between the arrangement according to the present embodiment and arrangements according to comparative examples. FIG. 19A is a schematic diagram (a diagram as viewed in the axial direction) of the metal plate cylindrical shaft 83 in a case (the present embodiment) in which the drive transmitting portions are arranged so as to satisfy $\angle A_1OP > \angle B_1OP$. FIG. 19B is a schematic diagram of the metal plate cylindrical shaft 83 in a case (a third comparative example) in which the drive transmitting portions are arranged so as to satisfy $\angle A_1OP < \angle B_1OP$. FIG. 19C is a schematic diagram of the metal plate cylindrical shaft 83 in a case (a fourth comparative example) in which the recessed grooves 831 are provided on the seam 830 (provided at overlapping positions in the circumferential direction).

When the metal plate cylindrical shaft 83 transmits a driving force to the pin 61, at drive transmitting portion points $A_1$ and $B_1$, the metal plate cylindrical shaft 83 receives a reaction force to the force applied to the pin 61 by the metal plate cylindrical shaft 83. When a driving force is transmitted by the metal plate cylindrical shaft 83 and forces are applied at the contact points $A_1$ and $B_1$, in the arrangement shown in FIG. 19C, the forces are applied in directions that cause the seam 830 to open. In the arrangement shown in FIG. 19B, since the forces act in directions that cause the seam 830 to open and in directions that cause the seam 830 to deviate in a radial direction, torsion of the shaft may possibly increase. Conversely, in the arrangement shown in FIG. 19A, since the forces are applied in directions that cause the seam 830 to close, the seam is prevented from opening. In addition, in the arrangement shown in FIG. 19A, although the forces are also applied in directions causing a deviation of the metal plate cylindrical shaft 83 in the radial direction in a similar manner to FIG. 19B, due to ends of a metal plate coming into contact with each other at the seam 830, the forces applied in directions causing the seam 830 to close become forces that push the ends of the metal plate of the seam 830 against each other. Accordingly, due to an increase in a friction force between the ends of the metal plate of the seam 830, a deviation of the metal plate cylindrical shaft 83 in the radial direction can be suppressed.

Therefore, the present embodiment adopts the configuration shown in FIG. 19A in which the seam 830 is less likely to open and a deviation of the metal plate cylindrical shaft 83 in the radial direction is less likely to occur. In addition, by arranging the recessed grooves 831 in this manner, the seam 830 of the metal plate cylindrical shaft 83 is prevented from opening or deviating and a torsional strength of the metal plate cylindrical shaft 83 is prevented from declining. Moreover, while a configuration in which $\angle B_1OP$ is an acute angle and $\angle A_1OP$ is an obtuse angle is adopted in the present embodiment, this configuration is not restrictive. For example, a configuration in which $\angle A_1OP$ is an approximately right angle can be appropriately adopted as long as the effect described above is produced.

As described above, in the metal plate cylindrical shaft 83 that is a metallic drive transmitting member, by configuring a positional relationship among the seam 830 of ends of a metal plate, a drive receiving portion on a drive input side, and a drive transmitting portion on a drive transmitting side as in the present embodiment, torsional strength of the metal plate cylindrical shaft 83 can be prevented from declining. Therefore, even with a hollow-structure cylindrical shaft created by forming a metal plate into a cylindrical shape, an inexpensive and readily workable drive transmitting mechanism (a drive transmitting apparatus) with high drive transmission accuracy can be provided without having to provide a shape requiring special machining considerations and without having to apply welding or adhesion to the seam 830.

Second Embodiment

A second embodiment of the present invention will now be described with reference to FIGS. 20A and 20B to FIGS. 26A to 26C. Moreover, the second embodiment only differs from the first embodiment in a shape of a metal plate cylindrical shaft that is a metallic drive transmitting member, a drive transmitting-side coupling, and a shape of a part of a roller-side coupling, while other portions are similar to the first embodiment and a description thereof will be omitted.

Figure 20A:
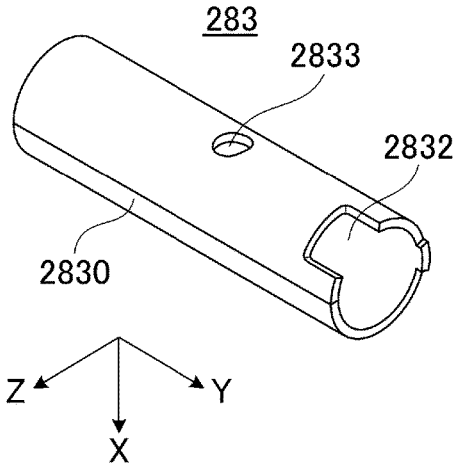
FIGS. 20A and 20B are diagrams showing a shape of a metal plate cylindrical shaft according to a second embodiment.
Figure 20B:
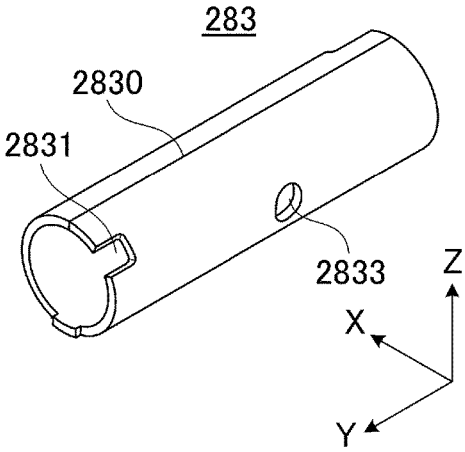

FIGS. 20A and 20B are diagrams showing a shape of a metal plate cylindrical shaft 283. In the present embodiment, one each of recessed grooves 2831 and 2832 for drive transmission is provided on the metal plate cylindrical shaft. Specifically, a configuration is adopted which is provided with one each of the force-receiving notched portion that engages with the first member and receives a driving force of the first member in a circumferential direction and the force-applying notched portion that engages with the second member and causes the driving force received from the first member to act on the second member in the circumferential direction according to the present invention. In addition, in the present embodiment, the first force receiving portion and the second force receiving portion according to the present invention are constituted by a same force receiving portion in a single force-receiving notched portion. In a similar manner, in the present embodiment, the first force applying portion and the second force applying portion according to the present invention are constituted by a same force applying portion in a single force-applying notched portion.

Figure 21:
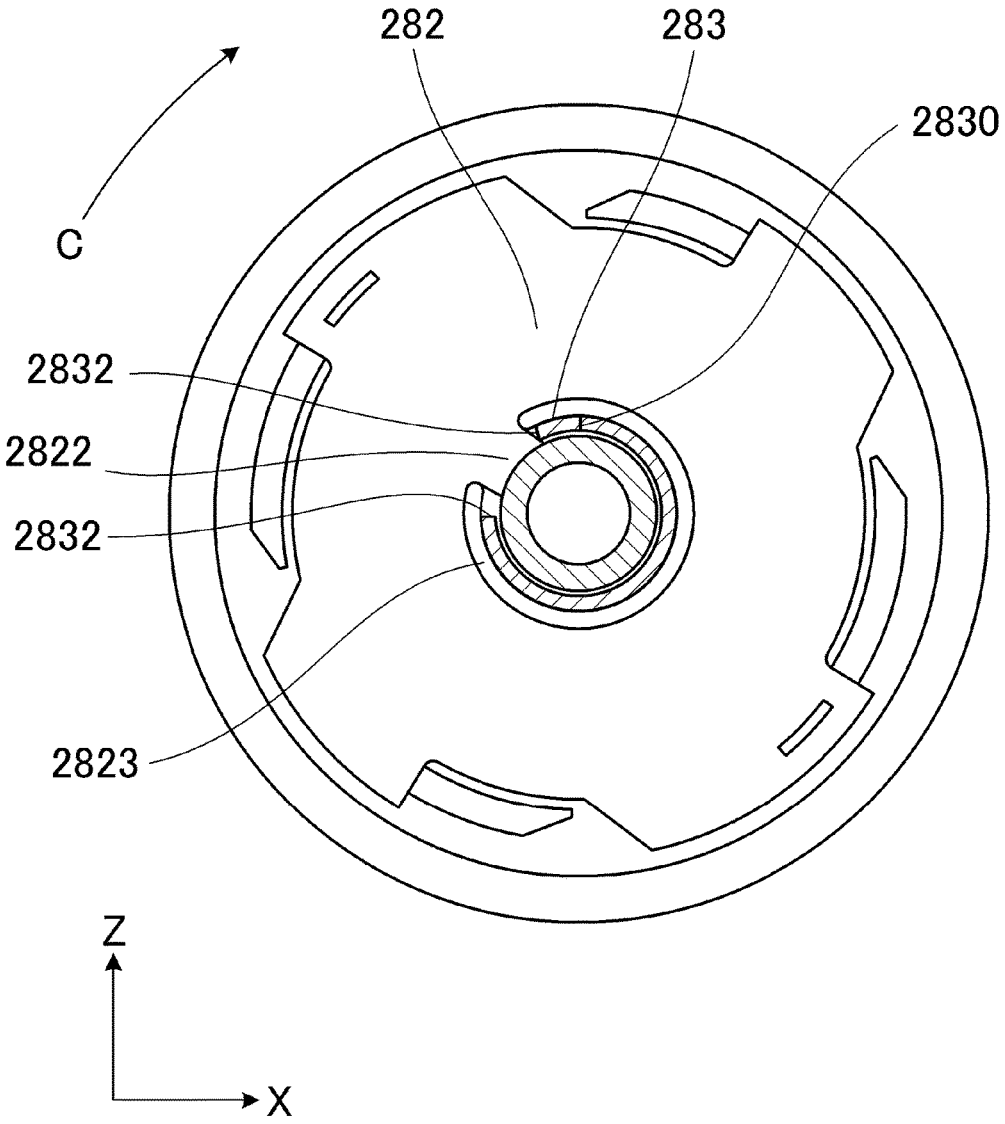
FIG. 21 is a sectional view showing a configuration of a drive input-side coupling according to the second embodiment.

FIG. 21 is a diagram which shows a configuration of a drive input-side coupling 280 that constitutes a drive input side according to the second embodiment and which corresponds to FIG. 13 according to the first embodiment. As shown in FIG. 21, one each of the recessed groove 2832 of the metal plate cylindrical shaft 283 and a protruded portion 2822 of a drive transmitting plate 282 is provided. In addition, a driving force transmitted from a driving source (not shown) to the drive transmitting plate 282 is transmitted from the drive transmitting plate 282 to the metal plate cylindrical shaft 283 at a contact point 2832A between the protruded portion 2822 protruding from an inner circumference of a hole 2823 of the drive transmitting plate 282 and the recessed groove 2832.

Figure 22:
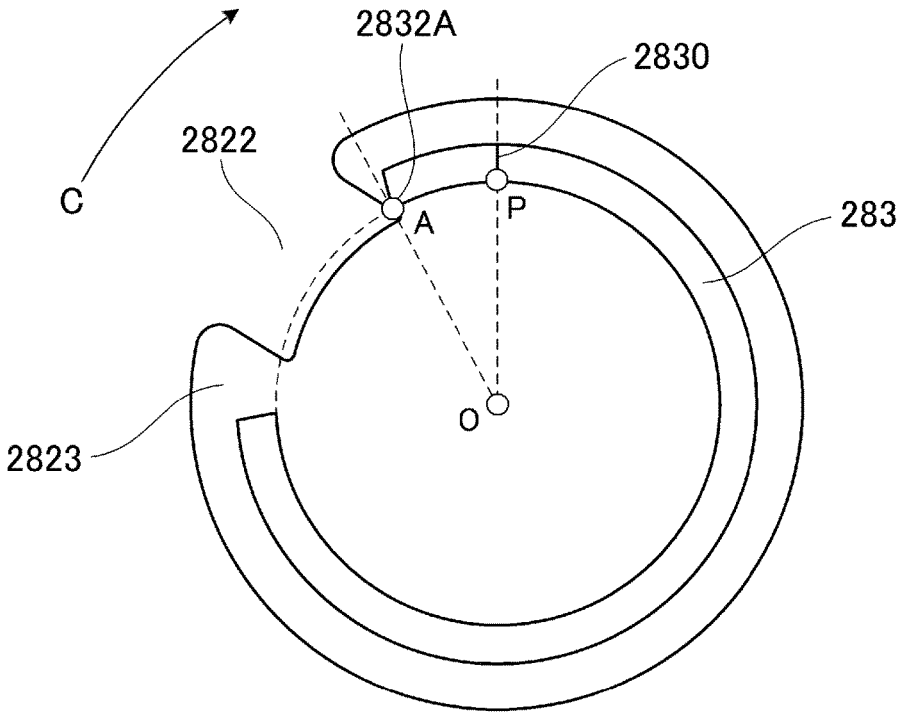
FIG. 22 is a sectional view showing a positional relationship between a drive receiving surface and a seam of the metal plate cylindrical shaft according to the second embodiment.

FIG. 22 is a diagram which shows a positional relationship between the contact point 2832A that is a drive transmission point of the metal plate cylindrical shaft 283 with the drive transmitting plate 282 and a seam 2830 and which represents a sectional view (that corresponds to FIG. 14 according to the first embodiment) passing through the contact point 2832A. In the sectional view shown in FIG. 22, a point O denotes a center (a rotational center) of the metal plate cylindrical shaft 283, a point P denotes an intersection of the seam 2830 and an inner circumferential surface of the metal plate cylindrical shaft 283, and a point A denotes the contact point 2832A. In the present embodiment, as shown in FIG. 22, an arrangement is adopted so that a central angle of an imaginary arc connecting the seam 2830 and the contact point 2832A in an opposite direction to the rotation direction C becomes smaller than a central angle of an imaginary arc connecting the seam 2830 and the contact point 2832A in the rotation direction C.

In this case, the imaginary arc connecting the seam 2830 and the contact point 2832A in the opposite direction (an opposite direction to a direction in which force is received) to the rotation direction C corresponds to the first imaginary arc according to the present invention. Specifically, a portion of the metal plate cylindrical shaft 283 at the contact point 2832A when connecting the seam 2830 and the contact point 2832A in the opposite direction to the rotation direction C corresponds to the drive transmitting portion (the first force receiving portion) nearest to the seam 2830 in the opposite direction. In addition, the imaginary arc connecting the seam 2830 and the contact point 2832A in the rotation direction C (the direction in which force is received) corresponds to the second imaginary arc according to the present invention. Specifically, a portion of the metal plate cylindrical shaft 283 at the contact point 2832A when connecting the seam 2830 and the contact point 2832A in the rotation direction C corresponds to the drive transmitting portion (the second force receiving portion) nearest to the seam 2830 in the rotation direction C (the direction in which force is received).

In other words, since only one drive transmission point 2832A is provided in the present embodiment, the drive receiving portion nearest to the seam 2830 in the opposite direction to the rotation direction C and the drive receiving portion nearest to the seam 2830 in the rotation direction C are the same drive transmission point. Therefore, when $\angle A_{ccw}OP$ denotes an angle from the point P to the point Ain the opposite direction to the rotation direction C and $\angle A_{cw}OP$ denotes an angle from the point P to the point A in the rotation direction C, the recessed groove 2832 is arranged so that $\angle A_{ccw}OP$ becomes smaller than $\angle A_{cw}OP$.

Figure 23A:
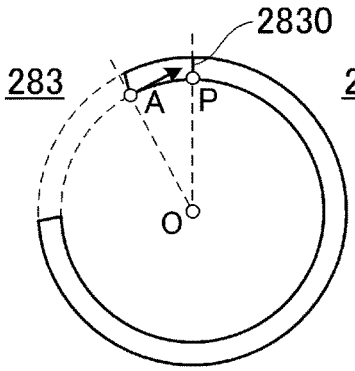
FIGS. 23A to 23C are diagrams showing a positional relationship between a drive receiving surface and a seam of a metal plate cylindrical shaft.
Figure 23B:
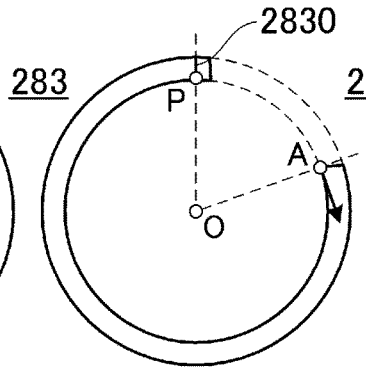
Figure 23C:
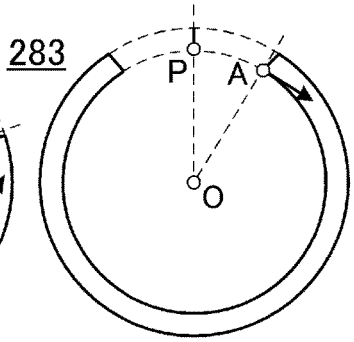

FIGS. 23A to 23C are schematic diagrams showing arrangements of the recessed groove 2832 and the seam 2830 in the form of a comparison between the arrangement according to the present embodiment and arrangements according to comparative examples. FIG. 23A is a diagram in a case (the present embodiment) in which the drive receiving portion is arranged with respect to the metal plate cylindrical shaft 283 as described above so as to satisfy $\angle A_{ccw}OP<\angle A_{cw}OP$. FIG. 23B is a diagram in a case (a fifth comparative example) which, conversely, satisfies $\angle A_{ccw}OP>\angle A_{cw}OP$, and FIG. 23C is a diagram in a case (a sixth comparative example) in which the recessed groove 2832 is provided on the seam 2830 (provided at overlapping positions in the circumferential direction as viewed in the axial direction).

When a driving force is transmitted to the metal plate cylindrical shaft 283 and a force is applied at the contact point A, with the arrangement shown in FIG. 23C, the force is applied in a direction that causes the seam 2830 to open. In the arrangement shown in FIG. 23B, since the force act in a direction that causes the seam 2830 to open and in a direction that causes the seam 2830 to deviate in a radial direction, torsion of the shaft may possibly increase. Conversely, in the arrangement shown in FIG. 23A, since a force is applied in a direction that causes the seam 2830 to close, the seam is prevented from opening. In addition, in the arrangement shown in FIG. 23A, although a force is also applied in a direction causing a deviation of the metal plate cylindrical shaft 283 in the radial direction in a similar manner to FIG. 23B, due to ends of a metal plate coming into contact with each other at the seam 2830, the force applied in a direction causing the seam 2830 to close becomes a force that pushes the ends of the metal plate at the seam 2830 against each other. Accordingly, due to an increase in a friction force between the ends of the metal plate of the seam 2830, a deviation of the metal plate cylindrical shaft 283 in the radial direction can be suppressed.

Therefore, the present embodiment adopts the configuration shown in FIG. 23A in which the seam 2830 is less likely to open and a deviation of the metal plate cylindrical shaft 283 in the radial direction is less likely to occur. In addition, a deviation of the ends of the metal plate at the seam 2830 in the axial direction of the metal plate cylindrical shaft 283 can be suppressed by providing the seam 2830 with a recessed shape and a protruded shape and causing the recessed shape and the protruded shape to fit with each other as shown in FIGS. 9A and 9B.

Figure 24:
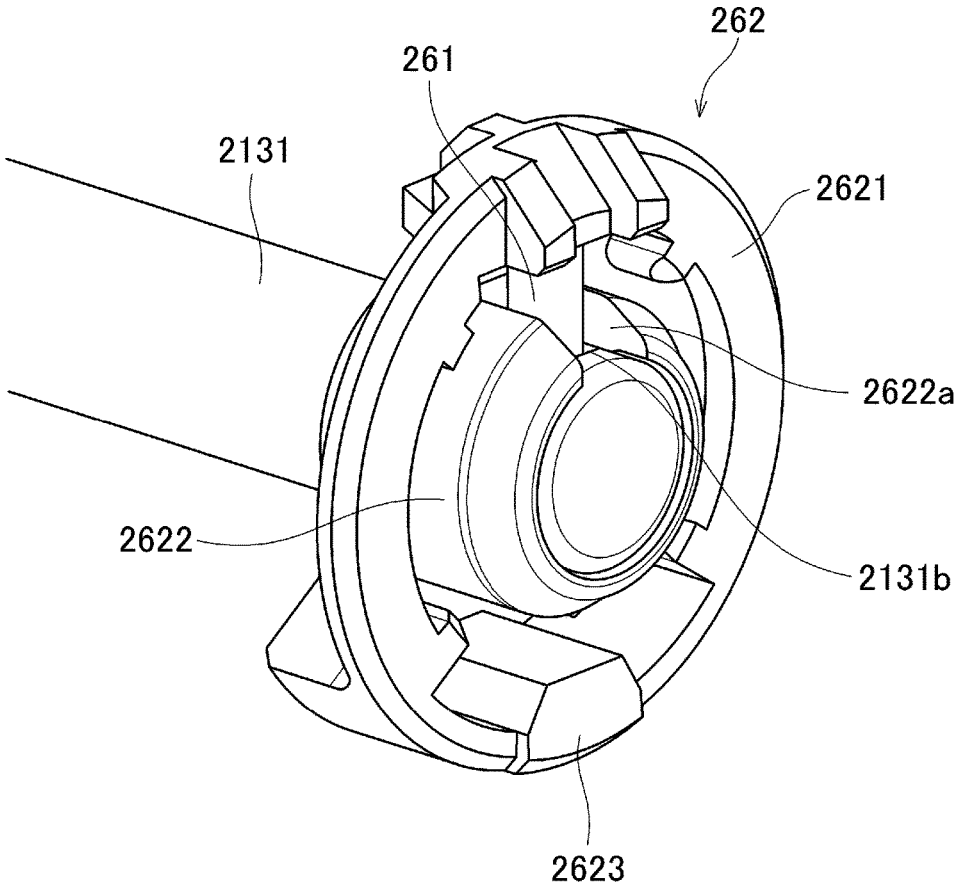
FIG. 24 is a diagram showing a configuration of a drive transmitting-side coupling according to the second embodiment.

FIG. 24 is a diagram which shows a configuration of a roller-side coupling 260 that constitutes a drive transmitting side and which corresponds to FIG. 16 according to the first embodiment. In the present embodiment, a pin 261 is inserted in a non-press-fitted state to a through-hole 2131*b* provided on a shaft 2131, and only one end of the pin 261 protrudes from an outer circumferential surface of the shaft 2131 and is held by the recessed groove 2831 provided on the metal plate cylindrical shaft 283. A resin cover member 262 to be attached to the shaft 2131 is formed in an approximately double annular shape and includes an outer ring portion 2621 (the second annular portion), an inner ring portion 2622 (the first annular portion), and a base portion 2623 (the coupling portion) that connects the outer ring portion and the inner ring portion with each other. A recessed groove 2622*a* as an engaging portion capable of engaging with the pin 261 in a rotation direction is formed in the inner ring portion 2622.

Figure 25:
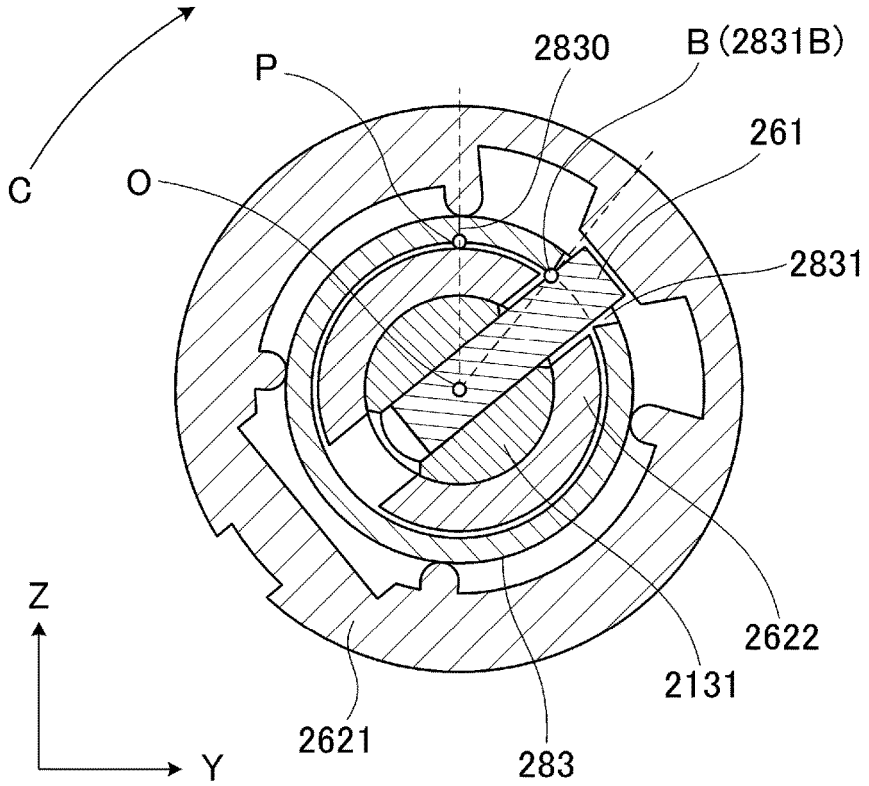
FIG. 25 is a sectional view showing a positional relationship between a drive transmitting surface and the seam of the metal plate cylindrical shaft according to the second embodiment.

FIG. 25 is a diagram which shows a positional relationship between a contact point 2831B that is a drive transmission point between the metal plate cylindrical shaft 283 and the pin 261 and a seam 2830 and which represents a sectional view (that corresponds to FIG. 18 according to the first embodiment) passing through the contact point 2831B of the metal plate cylindrical shaft 283. In a similar manner to the first embodiment, in FIG. 25, C denotes a rotation direction of the metal plate cylindrical shaft, a point O denotes a center of the metal plate cylindrical shaft, a point P denotes an intersection of the seam 2830 and an inner circumferential surface of the metal plate cylindrical shaft, and a point B denotes the contact point 2831B. In the present embodiment, as shown in FIG. 25, an arrangement is adopted so that a central angle of an imaginary arc connecting the seam 2830 and the contact point 2831B in an opposite direction to the rotation direction C becomes larger than a central angle of an imaginary arc connecting the seam 2830 and the contact point 2831B in the rotation direction C.

In this case, the imaginary arc connecting the seam 2830 and the contact point 2831B in the opposite direction (a direction in which force is received) to the rotation direction C corresponds to the second imaginary arc according to the present invention. Specifically, a portion of the metal plate cylindrical shaft 283 at the contact point 2831B when connecting the seam 2830 and the contact point 2831B in the opposite direction to the rotation direction C corresponds to the drive transmitting portion (the second force receiving portion that is also the second force applying portion) nearest to the seam 2830 in the opposite direction. In addition, the imaginary arc connecting the seam 2830 and the contact point 2831B in the rotation direction C (the opposite direction to the direction in which force is received) corresponds to the first imaginary arc according to the present invention. Specifically, a portion of the metal plate cylindrical shaft 283 at the contact point 2831B when connecting the seam 2830 and the contact point 2831B in the rotation direction C corresponds to the drive transmitting portion (the first force receiving portion that is also the first force applying portion) nearest to the seam 2830 in the rotation direction C.

In other words, since only one drive transmission point 2831B is provided in the present embodiment, the drive transmitting portion nearest to the seam 2830 in the opposite direction to the rotation direction C and the drive transmitting portion nearest to the seam 2830 in the rotation direction C are the same drive transmission point. Therefore, when $\angle B_{ccw}OP$ denotes a central angle from the point P to the point B in the opposite direction to the rotation direction C and $\angle B_{cw}OP$ denotes a central angle from the point P to the point B in the rotation direction C, the recessed groove 2831 is arranged so that $\angle B_{ccw}OP$ becomes larger than $\angle B_{cw}OP$.

Figure 26A:
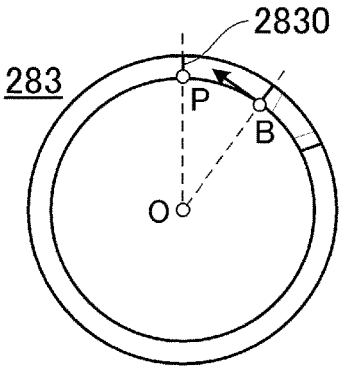
FIGS. 26A to 26C are sectional views showing a positional relationship between a drive transmitting surface and a seam of a metal plate cylindrical shaft.
Figure 26B:
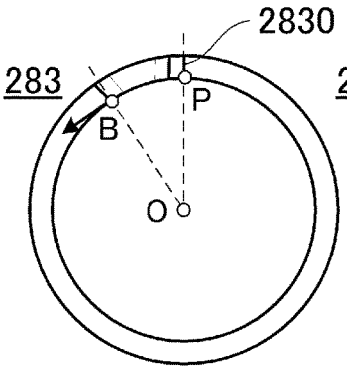
Figure 26C:
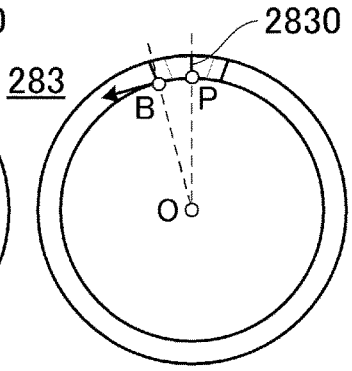

FIGS. 26A to 26C are schematic diagrams showing arrangements of the recessed groove 2831 and the seam 2830 in the form of a comparison between the arrangement according to the present embodiment and arrangements according to comparative examples. FIG. 26A is a diagram in a case (the present embodiment) in which the drive receiving portion is arranged with respect to the metal plate cylindrical shaft 283 as described above so as to satisfy $\angle B_{ccw}OP>\angle B_{cw}OP$. FIG. 26B is a diagram in a case (a seventh comparative example) which, conversely, satisfies $\angle B_{ccw}OP<\angle B_{cw}OP$, and FIG. 26C is a diagram in a case (an eighth comparative example) in which the recessed groove 2831 is provided on the seam 2830 (provided at overlapping positions in the circumferential direction as viewed in the axial direction).

In a similar manner to the first embodiment, when the metal plate cylindrical shaft 283 transmits a driving force to the pin 261, the metal plate cylindrical shaft 283 receives a reaction force at the drive transmitting portion point B. When the metal plate cylindrical shaft 283 transmits a driving force and a force is applied at the contact point B, in the arrangement shown in FIG. 26C, the force is applied in a direction that causes the seam 2830 to open. In the arrangement shown in FIG. 26B, since the force acts in a direction that causes the seam 2830 to open and in a direction that causes the seam 2830 to deviate in a radial direction, torsion of the shaft may possibly increase. Conversely, in the arrangement shown in FIG. 26A, since a force is applied in a direction that causes the seam 2830 to close, the seam is prevented from opening. In addition, in the arrangement shown in FIG. 26A, although a force is also applied in a direction that causes a deviation of the metal plate cylindrical shaft 283 in the radial direction in a similar manner to FIG. 26B, due to ends of a metal plate coming into contact with each other at the seam 2830, the force applied in a direction causing the seam 2830 to close becomes a force that pushes the ends of the metal plate of the seam 2830 against each other. Accordingly, due to an increase in a friction force between the ends of the metal plate of the seam 2830, a deviation of the metal plate cylindrical shaft 283 in the radial direction can be suppressed.

Therefore, the present embodiment adopts the configuration shown in FIG. 26A in which the seam 2830 is less likely to open and a deviation of the metal plate cylindrical shaft 283 in the radial direction is less likely to occur. In addition, by arranging the recessed groove 2831 in this manner, the seam 2830 of the metal plate cylindrical shaft 283 is prevented from opening or deviating and a torsional strength of the metal plate cylindrical shaft 283 is prevented from declining.

As described above, in the metal plate cylindrical shaft 283 that is a metallic drive transmitting member, by configuring a positional relationship among the seam 2830 of ends of a metal plate, a drive receiving portion on a drive input side, and a drive transmitting portion on a drive transmitting side as in the present embodiment, torsional strength of the metal plate cylindrical shaft 83 can be prevented from declining. Therefore, even with a hollow-structure cylindrical shaft created by forming a metal plate into a cylindrical shape, an inexpensive and readily workable drive transmitting mechanism (a drive transmitting apparatus) with high drive transmission accuracy can be provided without having to provide a shape requiring special machining considerations and without having to apply welding or adhesion to the seam 2830.

The drive transmitting apparatus according to the present invention includes:

a first member that drives;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam, a force-receiving notched portion that is recessed in the axial direction on an approximately annular end surface at one end in the axial direction, and a force-applying notched portion that is recessed in the axial direction on an approximately annular end surface at another end in the axial direction, the cylindrical shaft engaging with the first member in the force-receiving notched portion and receiving the driving force of the first member in the circumferential direction, and the cylindrical shaft engaging with the second member in the force-applying notched portion and causing the driving force to act on the second member in the circumferential direction, wherein when viewed in the axial direction, the seam, the force-receiving notched portion, and the force-applying notched portion are at different positions in the circumferential direction, a central angle of an imaginary arc connecting the seam and a first force receiving portion being a force receiving portion which receives the driving force in the circumferential direction at the force-receiving notched portion and which is nearest to the seam in an opposite direction to a rotation direction of the cylindrical shaft from the seam to the first force-receiving portion in the opposite direction and having as a center thereof the rotational center being smaller than a central angle of an imaginary arc connecting the seam and a second force receiving portion which is the force receiving portion and which is nearest to the seam in the rotation direction from the seam to the second force receiving portion in the rotation direction and having as a center thereof the rotational center, and a central angle of an imaginary arc connecting the seam and a first force applying portion being a force applying portion which causes the driving force to act on the second member at the force-applying notched portion and which is nearest to the seam in the rotation direction of the cylindrical shaft from the seam to the first force-applying portion in the rotation direction and having as a center thereof the rotational center being smaller than a central angle of an imaginary arc connecting the seam and a second force applying portion which is the force applying portion and which is nearest to the seam in the opposite direction to the rotation direction from the seam to the second force applying portion in the rotation direction and having as a center thereof the rotational center.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-206762, filed on Oct. 21, 2016, which is hereby incorporated by reference herein in its entirety.

What is claimed is:

1. A drive transmitting apparatus, comprising:

a first member;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam and a notched portion that is recessed in the axial direction on an approximately annular end surface at an end in the axial direction, and the cylindrical shaft receiving a force in the circumferential direction at the notched portion, wherein when viewed in the axial direction, the pair of circumferential ends and the notched portion are at different positions in the circumferential direction.

2. The drive transmitting apparatus according to claim 1, wherein the notched portion includes, as force receiving portions that receive the force in the circumferential direction, a first force receiving portion that is nearest to the pair of circumferential ends in an opposite direction to a direction, in which the force is received, and a second force receiving portion that is nearest to the pair of circumferential ends in the direction, in which the force is received, and when a first central angle denotes a central angle of a first imaginary arc, which connects the pair of circumferential ends and the first force receiving portion in the opposite direction from the pair of circumferential ends to the first force receiving portion, and which has as a center thereof a rotational center of the cylindrical shaft, and when a second central angle denotes a central angle of a second imaginary arc, which connects the pair of circumferential ends and the second force receiving portion in the direction in which the force is received from the pair of circumferential ends to the second force receiving portion, and which has as a center thereof the rotational center, the first central angle is smaller than the second central angle.

3. The drive transmitting apparatus according to claim 2, wherein the cylindrical shaft has a plurality of notched portions at at least one end in the axial direction, the plurality of notched portions at least includes a first notched portion provided at a position near to the pair of circumferential ends in the opposite direction and a second notched portion provided at a position near to the pair of circumferential ends in the direction in which the force is received, the first force receiving portion is the force receiving portion in the first notched portion, and the second force receiving portion is the force receiving portion in the second notched portion.

4. The drive transmitting apparatus according to claim 3, wherein the second notched portion is at a position farther from the pair of circumferential ends in the circumferential direction than the first notched portion.

5. The drive transmitting apparatus according to claim 2, wherein the cylindrical shaft has a single notched portion at at least one end in the axial direction, and the first force receiving portion and the second force receiving portion are the same force receiving portion in the single notched portion.

6. The drive transmitting apparatus according to claim 3, wherein the first central angle is an acute angle.

7. The drive transmitting apparatus according to claim 3, wherein the second central angle is an approximately right angle or an obtuse angle.

8. The drive transmitting apparatus according to claim 2, wherein the cylindrical shaft engages with the first member at the notched portion, rotates by receiving a driving force of the first member in a circumferential direction at the notched portion, and the force that the notched portion receives in the circumferential direction is a force received from the first member.

9. The drive transmitting apparatus according to claim 2, wherein the cylindrical shaft engages with the second member at the notched portion, and by rotating due to a driving force of the first member, causes the driving force to act on the second member in the circumferential direction at the notched portion, thereby driving the second member, and the force that the notched portion receives in the circumferential direction is a reaction force received from the second member when driving the second member.

10. A drive transmitting apparatus, comprising:

a first member;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam, and a notched portion that is recessed in the axial direction on an approximately annular end surface at an end in the axial direction, and the cylindrical shaft engaging with the first member in the notched portion and receiving the driving force of the first member in the circumferential direction, wherein when viewed in the axial direction, the pair of circumferential ends and the notched portion are at different positions in the circumferential direction.

11. The drive transmitting apparatus according to claim 10, wherein the notched portion includes, as force receiving portions that receive the driving force in the circumferential direction, a first force receiving portion that is nearest to the pair of circumferential ends in an opposite direction to a rotation direction of the cylindrical shaft and a second force receiving portion that is nearest to the pair of circumferential ends in the rotation direction, and when a first central angle denotes a central angle of an imaginary arc, which connects the pair of circumferential ends and the first force receiving portion in the opposite direction from the pair of circumferential ends to the first force receiving portion, and which has as a center thereof the rotational center, and when a second central angle denotes a central angle of an imaginary arc, which connects the pair of circumferential ends and the second force receiving portion in the rotation direction from the pair of circumferential ends to the second force receiving portion, and which has as a center thereof the rotational center, the first central angle is smaller than the second central angle.

12. A drive transmitting apparatus, comprising:

a first member that drives;

a second member that drives due to a driving force of the first member; and a cylindrical shaft that rotates in order to transmit the driving force of the first member to the second member, the cylindrical shaft including a pair of circumferential ends that oppose or abut with each other in a circumferential direction from one end to another end in an axial direction as a seam, and a notched portion that is recessed in the axial direction on an approximately annular end surface at an end in the axial direction, and the cylindrical shaft engaging with the second member in the notched portion and causing the driving force to act on the second member in the circumferential direction, wherein when viewed in the axial direction, the pair of circumferential ends and the notched portion are at different positions in the circumferential direction, the notched portion includes, as force applying portions that cause the driving force to act on the second member, a first force applying portion that is nearest to the pair of circumferential ends in a rotation direction of the cylindrical shaft and a second force applying portion that is nearest to the pair of circumferential ends in an opposite direction to the rotation direction, and when a first central angle denotes a central angle of an imaginary arc, which connects the pair of circumferential ends and the first force applying portion in the rotation direction from the pair of circumferential ends to the first force applying portion, and which has as a center thereof the rotational center, and when a second central angle denotes a central angle of an imaginary arc, which connects the pair of circumferential ends and the second force applying portion in the opposite direction from the pair of circumferential ends to the second force applying portion, and which has as a center thereof the rotational center, the first central angle is smaller than the second central angle.

13. The drive transmitting apparatus according to claim 1, wherein at the pair of circumferential ends, at least one protruded portion which protrudes in the circumferential direction and which is provided on one of the pair of circumferential ends, and at least one recessed portion which is recessed in the circumferential direction and which is provided on the other circumferential end, fit with each other.

14. The drive transmitting apparatus according to claim 13, wherein the protruded portion has a tapered shape in which the closer to a tip, the narrower a width in the axial direction, and the recessed portion has a flared shape in which the closer to an opening side, the wider a width in the axial direction.

15. The drive transmitting apparatus according to claim 1, wherein the cylindrical shaft is made of metal.

16. The drive transmitting apparatus according to claim 1, wherein the cylindrical shaft is a press-worked article.

17. An image forming apparatus, comprising:

the drive transmitting apparatus according to claim 1; and an image forming portion that forms an image on a recording material by using a driving force transmitted by the drive transmitting apparatus.

* * * * *